US006503123B2

(12) United States Patent
Chung

(10) Patent No.: US 6,503,123 B2
(45) Date of Patent: Jan. 7, 2003

(54) TOYS INCORPORATING GENEVA GEAR ASSEMBLIES

(75) Inventor: Caleb Chung, Boise, ID (US)

(73) Assignee: Toyinnovation, Inc., Redondo Beach, CA (US)

( * ) Notice: Subject to any disclaimer, the term of this patent is extended or adjusted under 35 U.S.C. 154(b) by 15 days.

(21) Appl. No.: 09/752,652

(22) Filed: Jan. 2, 2001

(65) Prior Publication Data

US 2001/0046829 A1 Nov. 29, 2001

Related U.S. Application Data

(60) Provisional application No. 60/173,977, filed on Dec. 30, 1999, and provisional application No. 60/175,445, filed on Jan. 4, 2000.

(51) Int. Cl.[7] ..... A63H 3/20

(52) U.S. Cl. ..... 446/330

(58) Field of Search ..... 74/436; 242/382.1, 242/382.4; 446/491, 330, 352, 353, 354, 355, 356, 358, 90, 457, 443

(56) References Cited

U.S. PATENT DOCUMENTS

| | | | | |
|---|---|---|---|---|
| 2,906,059 A | | 9/1959 | Berger | 46/245 |
| 3,456,383 A | | 7/1969 | Gardel et al. | 46/247 |
| 3,650,065 A | | 3/1972 | Johmann | 46/118 |
| 3,672,096 A | | 6/1972 | Johmann | 46/120 |
| 4,516,951 A | | 5/1985 | Saigo et al. | 446/338 |
| 4,801,285 A | | 1/1989 | Yeu | 446/298 |
| 4,805,328 A | | 2/1989 | Mirahem | 40/457 |
| 4,808,142 A | | 2/1989 | Berliner | 446/301 |
| 4,900,289 A | | 2/1990 | May et al. | 446/342 |
| 5,141,464 A | | 8/1992 | Stern et al. | 446/338 |
| 5,158,492 A | | 10/1992 | Rudell et al. | 446/175 |
| 5,413,517 A | | 5/1995 | Kamijima | 446/354 |
| 5,462,285 A | * | 10/1995 | O'Patka et al. | 124/16 |
| 5,468,172 A | | 11/1995 | Basile | 446/299 |
| 5,747,760 A | * | 5/1998 | Skarivoda | 200/37 R |
| 5,816,523 A | * | 10/1998 | Hori | 242/382.1 |
| 5,820,441 A | | 10/1998 | Pracas | 446/354 |
| 5,902,169 A | | 5/1999 | Yamakawa | 446/338 |
| 5,906,134 A | * | 5/1999 | Yamada | 74/436 |
| 5,911,617 A | | 6/1999 | Chou | 446/353 |
| 5,989,092 A | | 11/1999 | McGowan et al. | 446/175 |
| 6,149,490 A | | 11/2000 | Hampton et al. | 446/353 |
| 6,149,491 A | | 11/2000 | Arad et al. | 446/355 |

* cited by examiner

*Primary Examiner*—Jacob K. Ackun
(74) *Attorney, Agent, or Firm*—Christie, Parker & Hale, LLP

(57) ABSTRACT

Realistic looking and behaving life-like toys are provided. The toys include multiple moving parts. To achieve multiple movements geneva gear assemblies are incorporated in the toys wherein each assembly is driven by a single motor and can move multiple parts simultaneously or individually.

56 Claims, 23 Drawing Sheets

127
EYELID TO EYEBALL
2:1 RATIO
130
129
131
133

TOYS INCORPORATING GENEVA GEAR ASSEMBLIES

CROSS REFERENCE TO RELATED APPLICATIONS

This application is based upon and claims priority on U.S. Provisional Application No. 60/173,977 filed on Dec. 30, 1999, and on U.S. Provisional Application No. 60/175,445 filed on Jan. 4, 2000, the contents of both of which are incorporated herein by reference.

BACKGROUND OF THE INVENTION

To make a toy appear realistic, i.e., to make a toy simulate the movement and behavior of the human, animal or thing it represents, the toy must have multiple moving parts. To move such parts requires multiple motors, and in many instances more than ten motors. Use of so many motors adds to the cost and the weight of the toys making such toys undesirable. Consequently, toys are desired using a minimum number of motors that appear realistic.

SUMMARY OF THE INVENTION

Realistic looking and behaving, i.e., life-like toys are provided. The toys include multiple moving parts and appendages. When the toys are representative of a human or an animal, the toys may also include skin that is moveable. To achieve multiple movements of the parts, appendages and skin (collectively referred to herein as "parts") geneva gear assemblies are incorporated in the toys wherein each assembly is driven by a single motor and can move multiple parts simultaneously or individually. Each geneva gear assembly comprises one or more drive gears driven by a single motor and one or more output gears are driven by each drive gear. Pulleys are coupled to the output gears. Lines are coupled to the pulleys and to various parts such that rotation of the pulleys by the output gears causes movement of the parts.

A drive gear comprises a plurality of teeth which extend around a portion of the drive gear. A stop surface also spans a portion of each drive gear. An output gear also has a plurality of teeth and a stop surface section. As the drive gear rotates in a direction, its teeth engage the teeth of an output gear and rotate the output gear. As the drive gear continuous to further rotate its gear teeth disengage from the gear teeth of the output gear and the stop surface of the drive gear mates with and rotates by the stop surface of the output gear preventing the output gear rotation. Another output gear may be driven simultaneously by the same or another drive gear.

DETAILED DESCRIPTION OF THE INVENTION

Toys comprising inventive geneva gear assemblies for driving multiple moving parts are provided. The geneva gear assemblies allow for the movement of multiple parts, appendages and/or skin (collectively referred to herein as "parts") individually or simultaneously using a single motor. In this regard, the number of motors that need to be incorporated in the toys is minimized thereby minimizing the weight and cost of the toys. Consequently, toys can be made using the inventive geneva gear assemblies that have multiple moving parts, each part having multiple movements. Thus, these toys appear to be more realistic in that they can more realistically simulate the movements of the real people or devices that these toys represent.

Figure 1A:
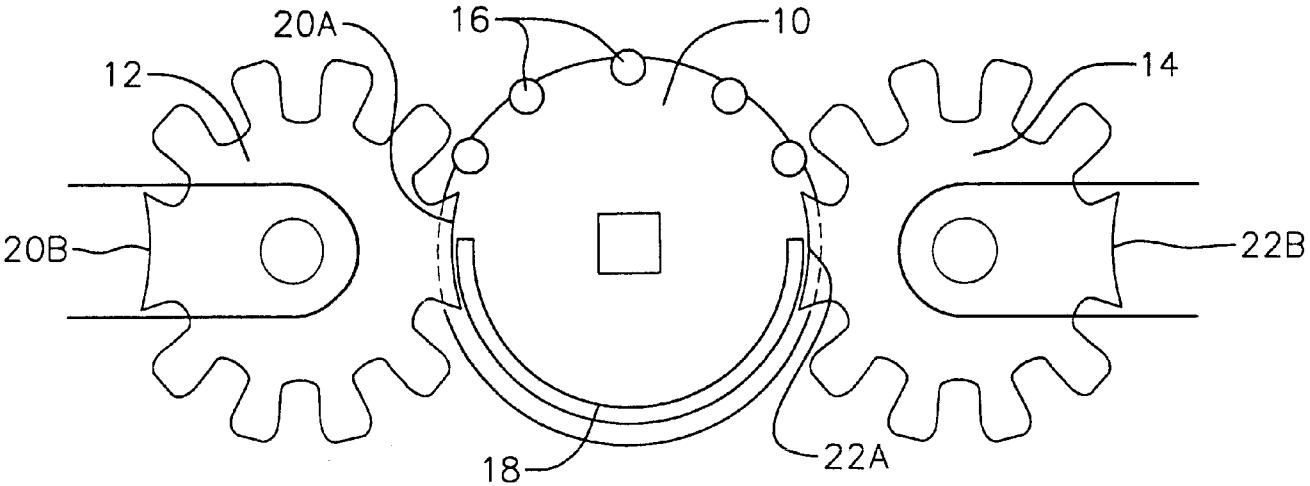
FIG. 1A is a top view of a geneva gear assembly of the present invention excluding the pulleys.
Figure 1B:
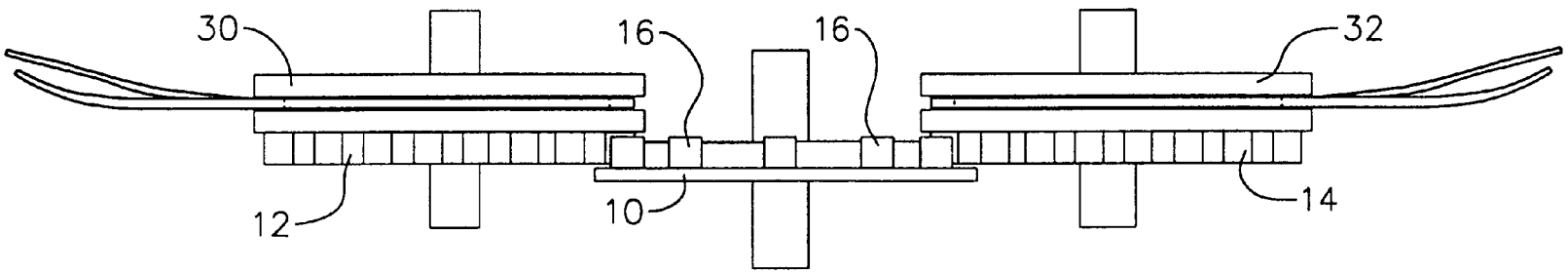
FIG. 1B is an end view of the geneva gear assembly of the present invention shown in FIG. 1A and including the pulleys.

In an exemplary embodiment, as shown in FIGS. 1A and 1B, an inventive geneva gear assembly comprises a drive gear 10, a first output gear 12 and a second output gear 14. The drive gear is driven to rotate by a motor (not shown) . The drive gear 10 comprises a plurality of teeth or pins 16 which are arcuately spaced apart and extend perpendicularly from a surface of the drive gear proximate the periphery of the drive gear. The teeth 16 only extend around a portion of the drive gear which is typically less than half of the gear circumference and typically may span an area of about 160°.

A stop arcuate member 18 arcuately spans the remaining portion of the drive gear not occupied by the teeth. The first output gear 12 has two stop teeth or stop portions or stop members, referred to collectively referred to herein for convenience as "stop teeth" 20A and 20B located opposite each other. Similarly the second output gear 14 has two stop teeth 22A and 22B located opposite each other. The stop teeth have an arcuate surface complementary to the outer surface of the stop member 18 of the drive gear 10. A stop tooth may occupy a major portion of half a gear circumference. When a stop tooth of an output gear is positioned adjacent the stop member, it prevents the output gear from turning, thus, locking it in position. Because the outer surfaces of the stop teeth are complementary to the outer surface of the stop member, they allow the stop member to rotate relative to and past the stop teeth. The length of the arcuate stop member may be long enough such that it can engage a stop tooth of each output gear simultaneously.

As the drive gear rotates in a direction, its teeth 16 engage the teeth of an output gear and rotate the output gear. For example, as the drive gear 10 shown in FIG. 1 rotates 180° clockwise, its teeth 16 mesh with the teeth 15 of the second output gear 14 causing the second output gear to rotate 180° in a counterclockwise direction. At the same time, the stop member 18 of the drive gear 16 prevents the first output gear 12 from rotating by being positioned adjacent to the stop tooth 20A of the first output gear 12 throughout the 180° travel of the drive gear. If the drive gear continues to rotate another 180° clockwise its teeth will then mesh with the teeth of the first output gear and rotate it 180° counterclockwise. When that occurs, the stop member 18 of the drive gear is positioned adjacent to a stop tooth 22B of the second output gear thereby preventing the rotation of the second output gear. The reverse occurs as the drive gear is rotated in a counterclockwise direction. An advantage of the inventive geneva gear assembly is that it allows rotation of one of its output gears while locking its other output gear.

Figure 2A:
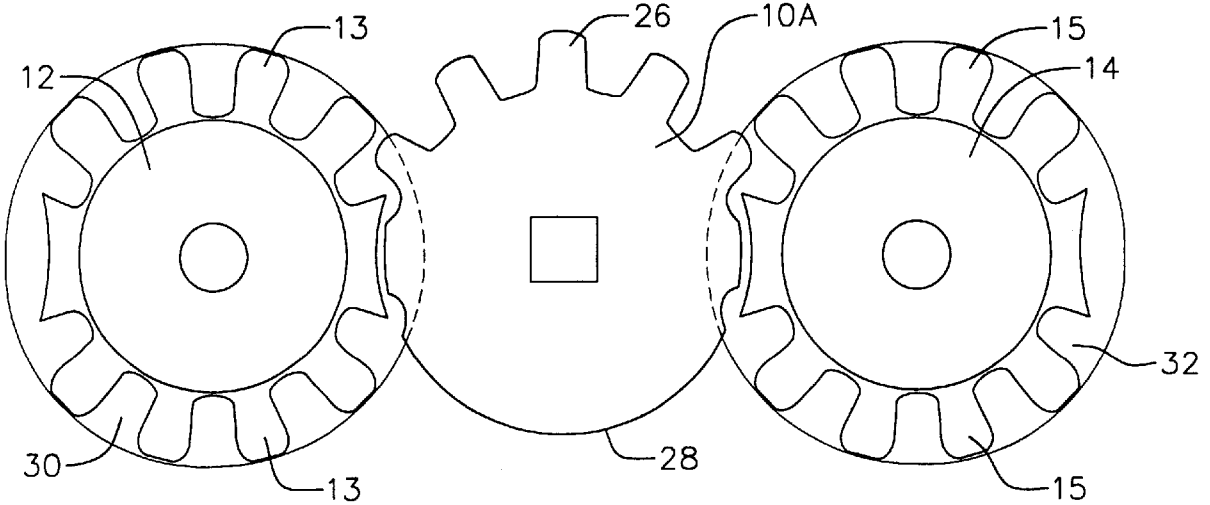
FIG. 2A is a top view of an alternate embodiment geneva gear assembly of the present invention.
Figure 2B:
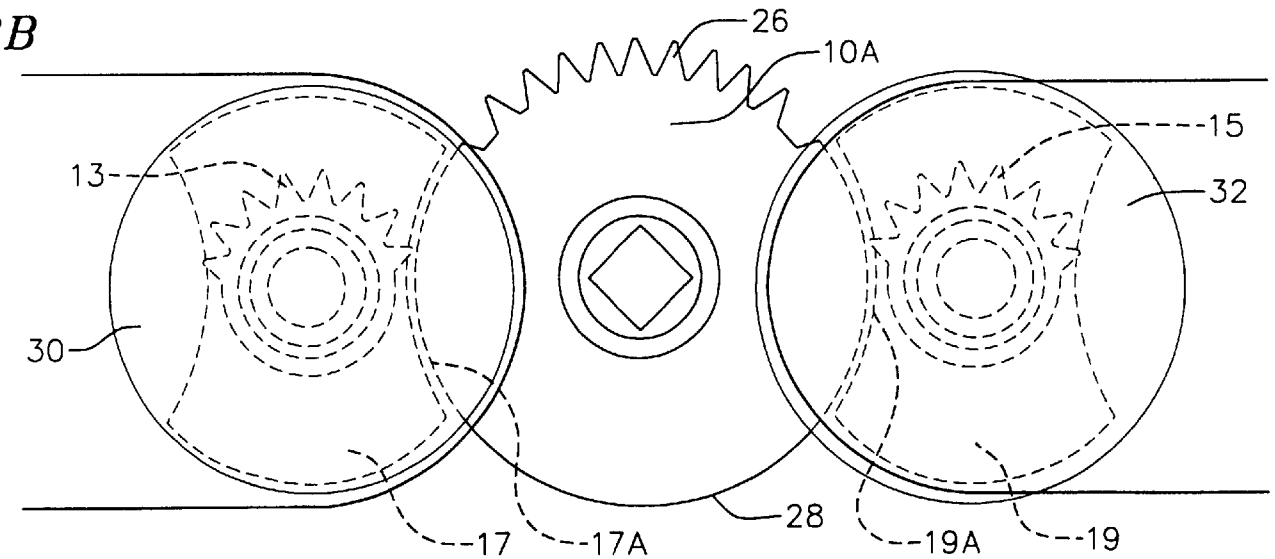
FIG. 2B is a top view of a further alternate embodiment geneva gear assembly of the present invention.

In an alternate embodiment, instead of incorporating a drive gear having teeth which protrude perpendicularly from the surface of the drive gear, the drive gear 10A of the geneva gear assembly is formed with gear teeth 26 for interfacing with the teeth 13, 15 of the first and second gears, respectively, as shown in FIGS. 2A and 2B. Moreover, instead of using a stop member, the diameter of the drive gear is such that the perimeter 28 of the drive gear serves as a stop as shown in FIGS. 2A and 2B. Furthermore, each drive gear and output gear can have multiple sets of gear teeth separated by multiple sets of stop surfaces or stop members as shown in FIGS. 1A and 2A. Alternatively a drive gear or output gear may have a single set of gear teeth 13, 15, or 26. Furthermore, the output gear stop surface may be in the form of a follower 17, 19 having at least a curved edge 17A, 19A that is complementary to the stop surface 28 of the drive gear. In the exemplary embodiments shown in FIG. 2B, the output gear followers 17, 19 each have opposing curved edges 17A, 17B, and 19A, 19B that are complementary to the stop surface of the drive gear.

In an exemplary embodiment, the gear teeth of each output gear 12, 14 are formed coaxially with pulleys 30, and 32, respectively as shown in FIGS. 1B, 2A and 2B. Specifically a pulley is coupled to each gear. The pulleys are preferably spring coupled to the gears. In this regard, the pulley may be made to turn relative to the gear by overcoming the force of the spring coupling the pulley to the gear.

Two flexible lines, wires or cables (either of which is referred to herein as "lines" for convenience), are fixed to each pulley. In this regard, as the gear and pulley rotate in a first direction, they wind the first line and unwind the second line. Similarly, as the gear and pulley rotate in the opposite direction they unwind the first line and wind the second line. Instead of using two lines, a single line may be wrapped around the pulley and fixed at a single location or may just be tightly wound around the pulley.

Figure 3A:
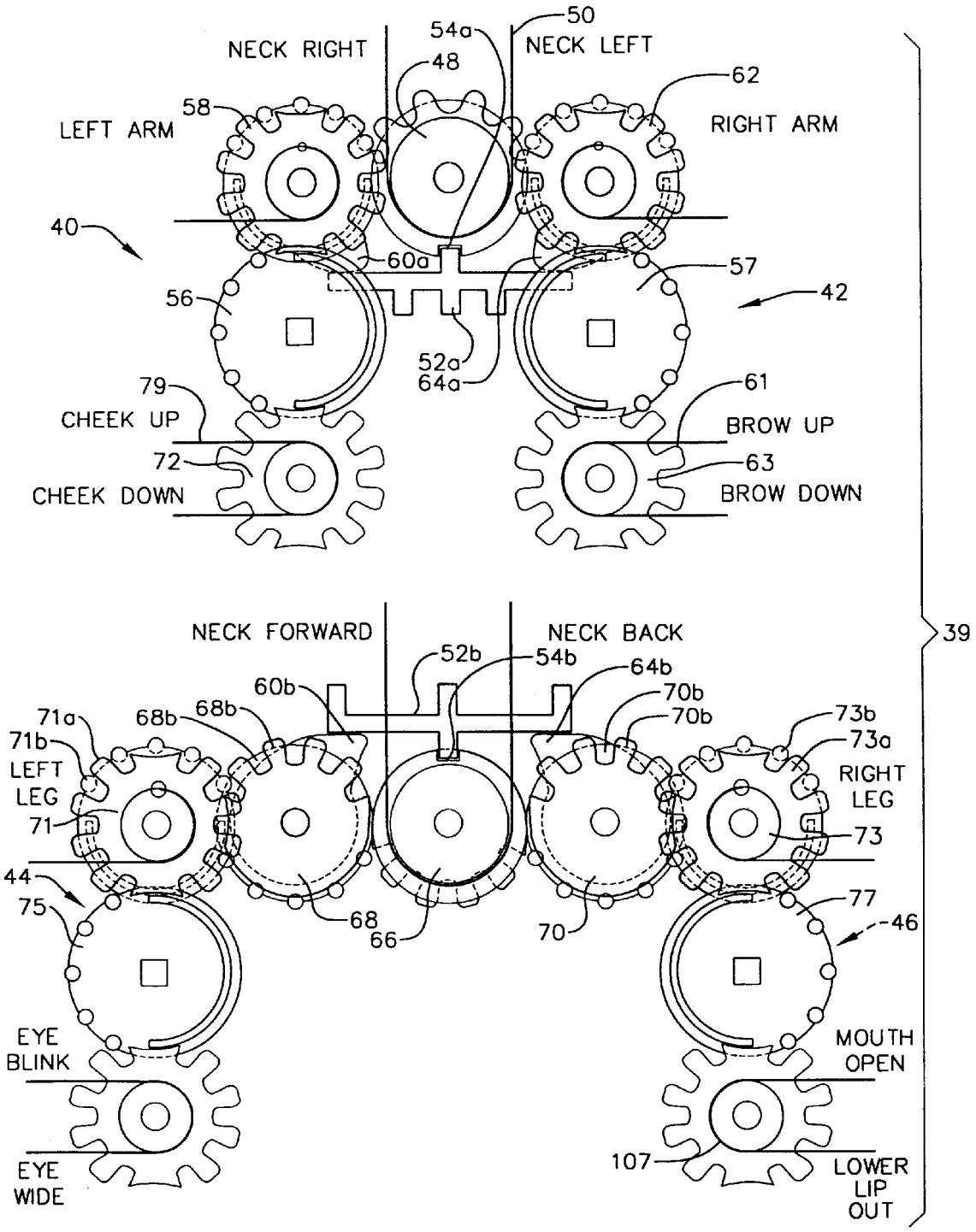
FIG. 3A is an arrangement of four geneva gear assemblies as incorporated into the torso of a baby doll toy of the present invention.

In an exemplary embodiment toy shown in FIG. 3A, geneva gear assemblies are incorporated in a baby doll 39 to provide the doll with realistic movements and behaviors such as the movements and behaviors typically exhibited by a human baby. In the exemplary embodiment shown in FIG. 3A, four geneva gear assemblies are incorporated which are disposed within the doll's torso. Each geneva gear assembly comprises a drive gear driven by a motor and two output gears and operates as described above in relation to the geneva gear assemblies shown in FIGS. 1A, 1B, 2A and 2B.

In the exemplary embodiment shown in FIG. 3A, the first gear assembly 40 is driven by a first motor (not shown) and is used to retract the left arm, to move the cheeks up or down, and to turn the neck to the right. The second geneva gear assembly 42 is identical to the first geneva gear assembly and is driven by a second motor (not shown) and is used to retract the right arm, i.e., bend the right arm, move the brows up or down, or move the neck to the left. The third geneva gear assembly 44 is driven by a third motor (not shown) and is used to bend the left leg, cause the eyes to blink or to open wide and the neck to move forward. The fourth geneva gear assembly 46 is driven by a fourth motor (not shown) and is used to cause the right leg to bend, the mouth to open, the lower lip to move out (by closing the mouth) and the neck to move backwards.

Figure 3B:
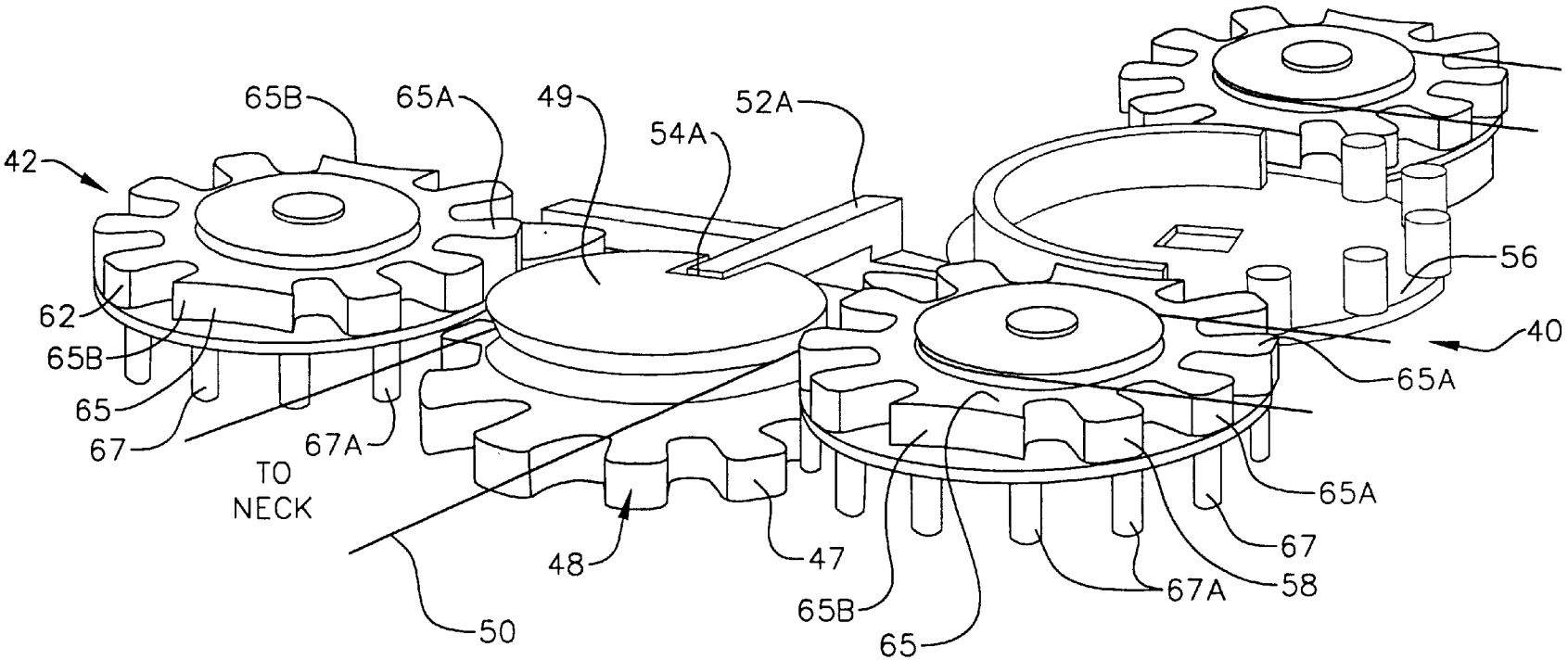
FIG. 3B is a partial perspective end view of geneva gear assemblies shown in FIG. 3A.

The neck right and neck left movements are controlled by gear/pulley combination 48 (i.e., a gear 47 coaxially coupled to a pulley 49 as for example shown in FIG. 3B) coupled to the first and second geneva gear assemblies. A locking member 52*a* slidably engages a slot 54*a* formed on the gear of the gear/pulley 48 for locking the gear/pulley 48 and preventing its rotation. The locking member 52*a* is preferably spring loaded in a position locking the gear/pulley 48.

In the exemplary embodiment doll shown in FIGS. 3A, when the drive gear 56 of the first geneva gear assembly 40 is turned 360° counterclockwise it causes output gear 58 with corresponding pulley 59 to turn clockwise (see also FIG. 3B). A cam member 60*a* extends from the pulley 59. As the output gear 58 rotates clockwise, a cam member 60*a* extending from the output gear 58 engages the lock member 52*a* causing it to disengage from the slot 54*a*, thus allowing the gear 48 to rotate. Similarly, the output gear 62 with corresponding pulley of the second geneva assembly 42 is also fitted with a cam member 64*a* for urging the lock member 52*a* away from the slot 54*a* formed on the gear of the gear/pulley 48.

Because the output gears 58 and 62 interface with their corresponding drive gears 56 and 57, respectively and because they also interface with the gear/pulley 48, each of the output gears 58, 62 comprises a two sections. The first section 65 comprises gear teeth 65A (as for example shown in FIG. 3B) or pins and stop teeth 65B for interfacing with a corresponding drive gear. The second section 67 extends coaxially from the first section and comprises pins 67A (as for example shown in FIG. 3B) or teeth for interfacing with the gear 47 of the gear/pulley combination 48.

The third and fourth geneva assemblies 44, 46 are also similarly coupled to a gear/pulley 66 for moving the neck forward and backward. However, intermediate gears 68 and 70 may be used as shown in the exemplary embodiment depicted in FIG. 3A to further space apart the third and fourth geneva gear assemblies. Further spacing of the geneva gear assemblies may be required for providing enough space to accommodate a battery box which will house the batteries that will drive the four geneva gear assembly motors. If intermediate gears are used, then cam members 60*b* and 64*b* may be coupled to the intermediate gears 68 and 70, respectively, for urging lock member 52*b* away from slot 54*b* formed on gear/pulley 66.

Figure 3C:
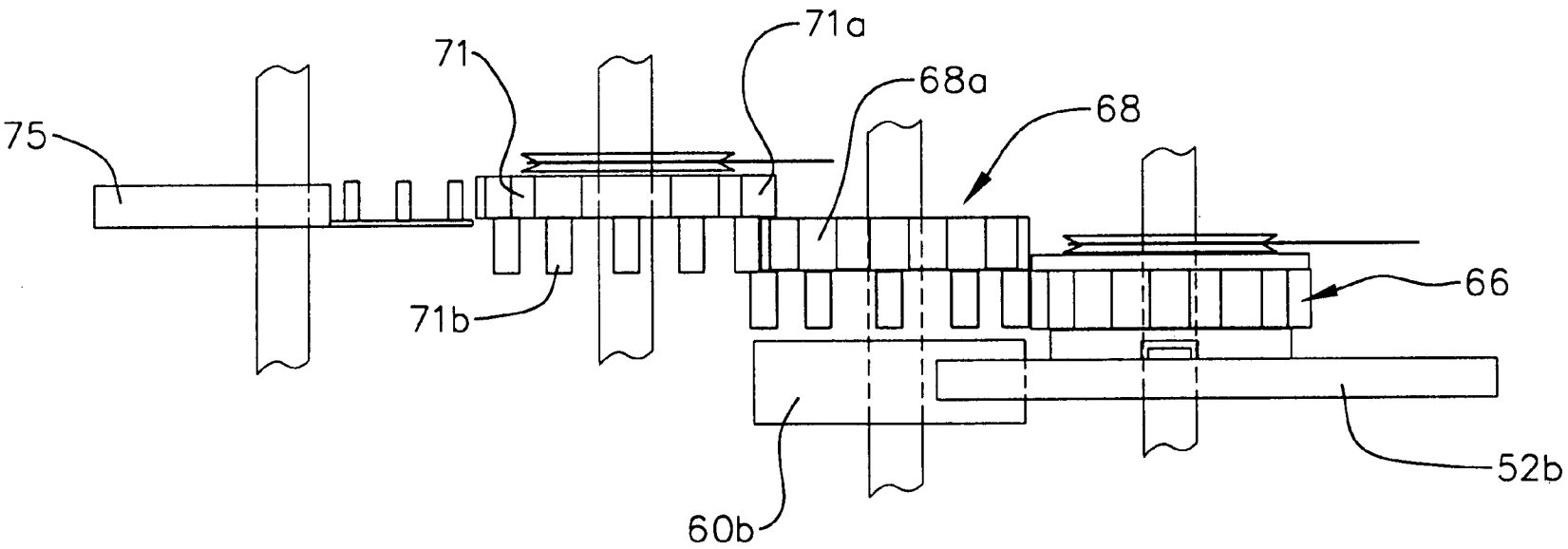
FIG. 3C is a partial end view of geneva gear assemblies shown in FIG. 3A.

Because the output gears 71 and 73 interface with their corresponding drive gear 75 and 77, respectively as well as with their corresponding intermediate gear 68 and 70, respectively, both output gears 71 and 73 comprise two coaxial output gear sections. A first coaxial section 71*a* (or 73*a*) for interfaces with the corresponding drive gear 75, as for example shown in FIG. 3C. The second coaxial section 71*b* (or 73*b*) interfaces with its corresponding intermediate gear 68 as for example shown in FIG. 3C (or 70). Similarly, each intermediate gear 68 comprises two coaxial gear sections 68*a*( or 70*a*) for interfacing with its corresponding output gear second coaxial section 71*b* (of 73*b*), and a coaxial section for interfacing with gear/pulley 66.

Figure 4:
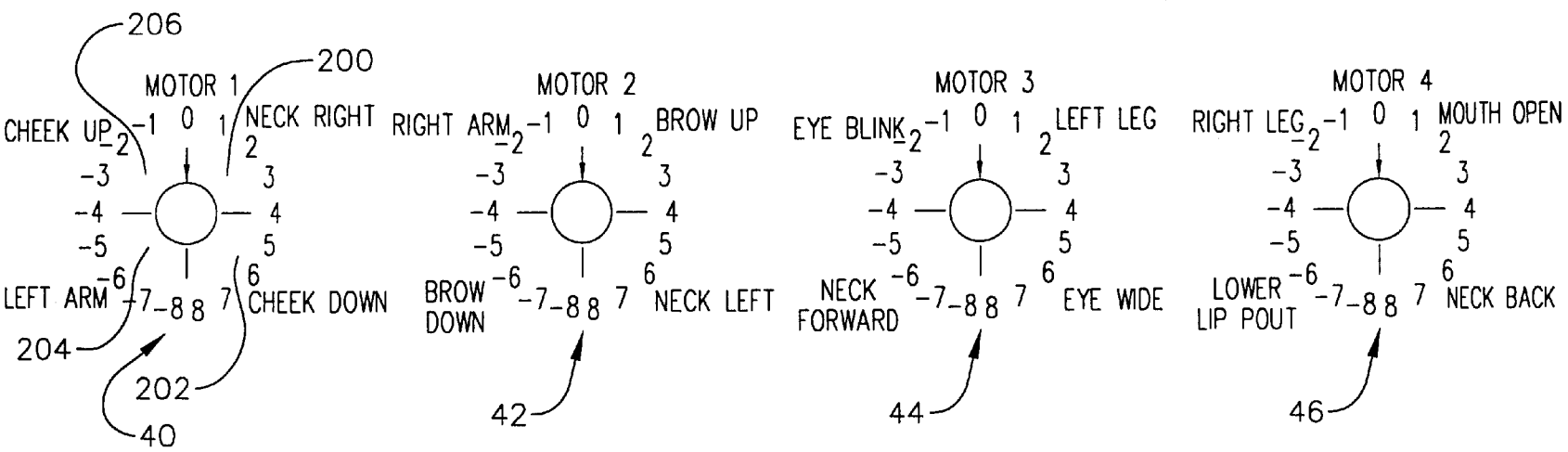
FIG. 4 depicts a mapping of the movements to be accomplished by each of the geneva gear assemblies depicted in FIG. 3A.

FIG. 4 depicts an exemplary mapping of the movements provided to the doll by the four geneva gear assemblies 40, 42, 44 and 46. Each movement caused by each geneva gear assembly is depicted in quadrants 200, 202, 204, and 206. Each quadrant denotes an 180° rotation of the geneva gear assembly drive gear. For example, 180° counterclockwise rotation of the drive gear of the first geneva gear assembly 40 will cause the cheek of the baby to move up. Each drive gear is allowed to rotate a maximum of 360° in either direction. Each motor and thereby, each gear may be rotated in increments so as to achieve a movement scheme mimicking the movements of a real baby. In the preferred embodiment, each motor and its corresponding drive gear can rotate to 16 different positions from their origin, eight when rotating 360° in a clockwise direction form their origin and eight when rotating 360° in a counterclockwise direction from their origin as shown in FIG. 4. The clockwise positions are designated by numerals 1 to 8, while the counterclockwise positions are designated by numerals –1 to –8 in FIG. 4.

In the exemplary embodiment, if the drive gear of the first geneva gear assembly rotates 360° in a counterclockwise direction it will cause the cheek of the baby to move up and the neck to move to the right. In order to move the left arm or to move the cheek down, the drive gear must rotate 360°0 in a clockwise direction to its original position and then another 360° clockwise. During the first 180° clockwise rotation of the drive after it returns to its original position, the left arm bends and retracts. During the second 180° clockwise rotation the cheeks of the baby will be moved downward creating a sad face. It should be noted that in the preferred mapping of the movement of the four geneva gear assemblies, each geneva gear controls one of either the left arm, right arm, left leg, or right leg. In this regard, each of these appendages can be moved independent of the other. Moreover, the movements most often used are mapped on the top two quadrants of each map for each of the geneva gear assemblies. In other words, the most often used movements occur during the first 180° of clockwise or counterclockwise rotation of the drive gear of each geneva gear assembly.

It should be noted that in order to get a movement mapped on a bottom quadrant of a geneva gear assembly, the movement mapped on the quadrant directly above the bottom quadrant must occur first. For example, in order to get a sad look on the baby using four geneva gear assemblies mapped as shown in FIG. 4, the motor of the second geneva assembly 42 moves the drive gear 360° counterclockwise causing the brows of the baby to move downward. In order to move the brows downward, the baby's right arm must first be bent and retracted. Moreover, the drive gear of the fourth geneva assembly 46 is also rotated 360° counterclockwise causing the jaw to move closing the baby's mouth which causes the baby's soft lower lip to move outward as though it is pouting. In order to cause the lower lip to move outward, the fourth geneva assembly must first cause the right leg to bend.

The baby doll body is covered by a soft flexible skin, resembling the skin of a real human baby. In a preferred embodiment, the skin is made from urethane material or foam rubber. Urethane and foam rubber allows the skin to flex and stretch and to contract to its original position after it has been stretched.

Figure 5A:
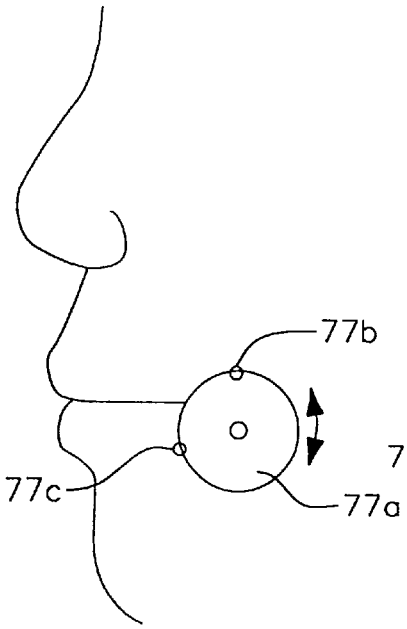
FIGS. 5A, 5B and 5C depict the assembly used to move the ends of an exemplary doll's mouth as well as its cheeks and also depict a portion of the side of the baby doll's face with the mouth in a neutral position, the mouth and cheeks moved upward to create a smile, and the mouth and cheeks moved downward to create a sad face, respectively.
Figure 5B:
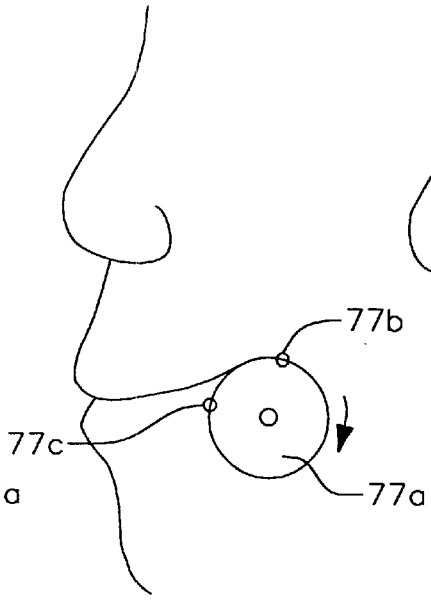
Figure 5C:
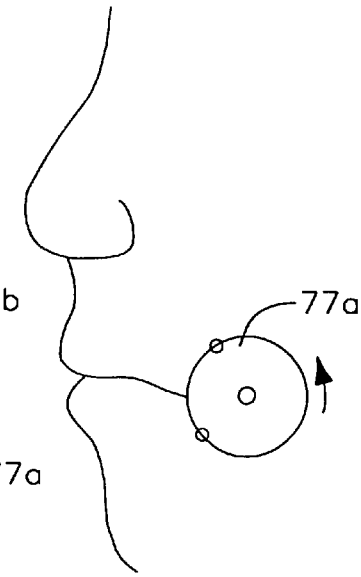
Figure 5D:
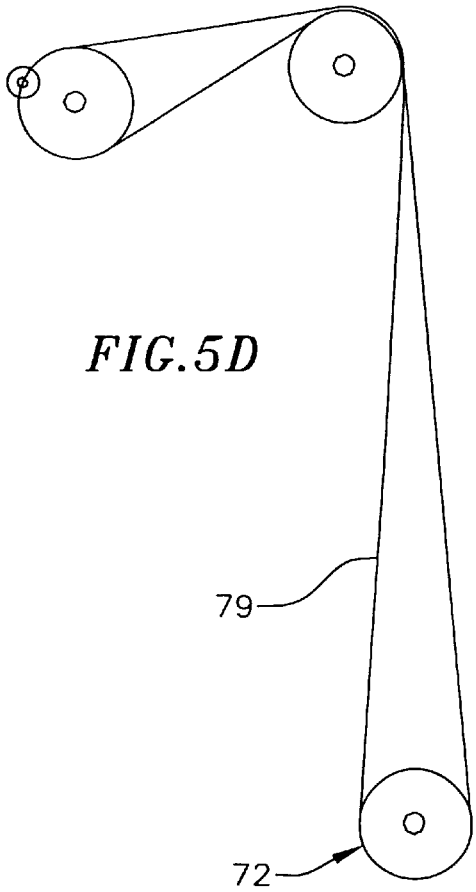
FIG. 5D schematically depicts the operation of the assembly shown in FIGS. 5A, 5B and 5C.
Figure 6:
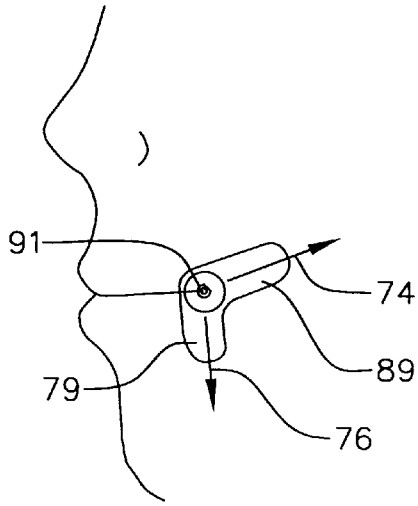
FIG. 6 is an alternate embodiment assembly for moving the ends of the mouth and the cheeks of the exemplary baby doll.

To cause the baby doll to smile, the cheeks of the baby need to move upward. Similarly, to cause the baby to have a sad face, the cheeks of the baby need to move downward. In a first exemplary embodiment, this is accomplished by incorporating a rotatable disc member 77*a* at either end of the mouth as shown in FIGS. 5A, 5B, and 5C. The disc members are rotatably coupled to the skull or structure forming the baby's head. The baby doll's skin at each end of its mouth is attached to two points 77*b* and 77*c* at the periphery of a corresponding disc. In the exemplary embodiment, the discs on both sides of the mouth are coupled to the pulley of first output gear 72 of the first geneva assembly 40 via lines 79, one of which is shown in FIG. 5D. As the first geneva assembly 40 output gear 72 is rotated clockwise by the counterclockwise rotation of the drive gear 56, it causes the disc members 77*a* (one of which) is shown in FIG. 5B to rotate causing the skin at the ends of the mouth which is attached to the discs 77*a* to rotate to an up position, providing the appearance of the smile. Similarly, a 360° counterclockwise rotation of the drive gear 56 of the first gear assembly will cause the ends of the mouth attached to the discs 77*a* to rotate to a downward position as shown in FIG. 5C giving the appearance of a sad face.

In an alternate embodiment, instead of using discs a slot 71 may be formed at each end of the mouth as shown in FIG.

6. A pin 91 is slidably fitted within each slot such that it can slide along the length of the slot. The skin at each end of the mouth is attached to the each moveable pin. Each slot 72 is generally "L" shaped having a first leg 89 extending at an angle relative to a second leg 79. Movement of the pins in a first direction 74 along the first leg 89 will cause a smile whereas movement in a second direction 76 along the second leg 79 will cause a sad face. Attachment of the skin to the discs 70*a* or the pins 91 may be by means of a button or by use of an adhesive. Once the drive gear of the first geneva gear assembly returns to its original position, the flexibility of the skin causes the mouth to return to its original position.

Figure 9:
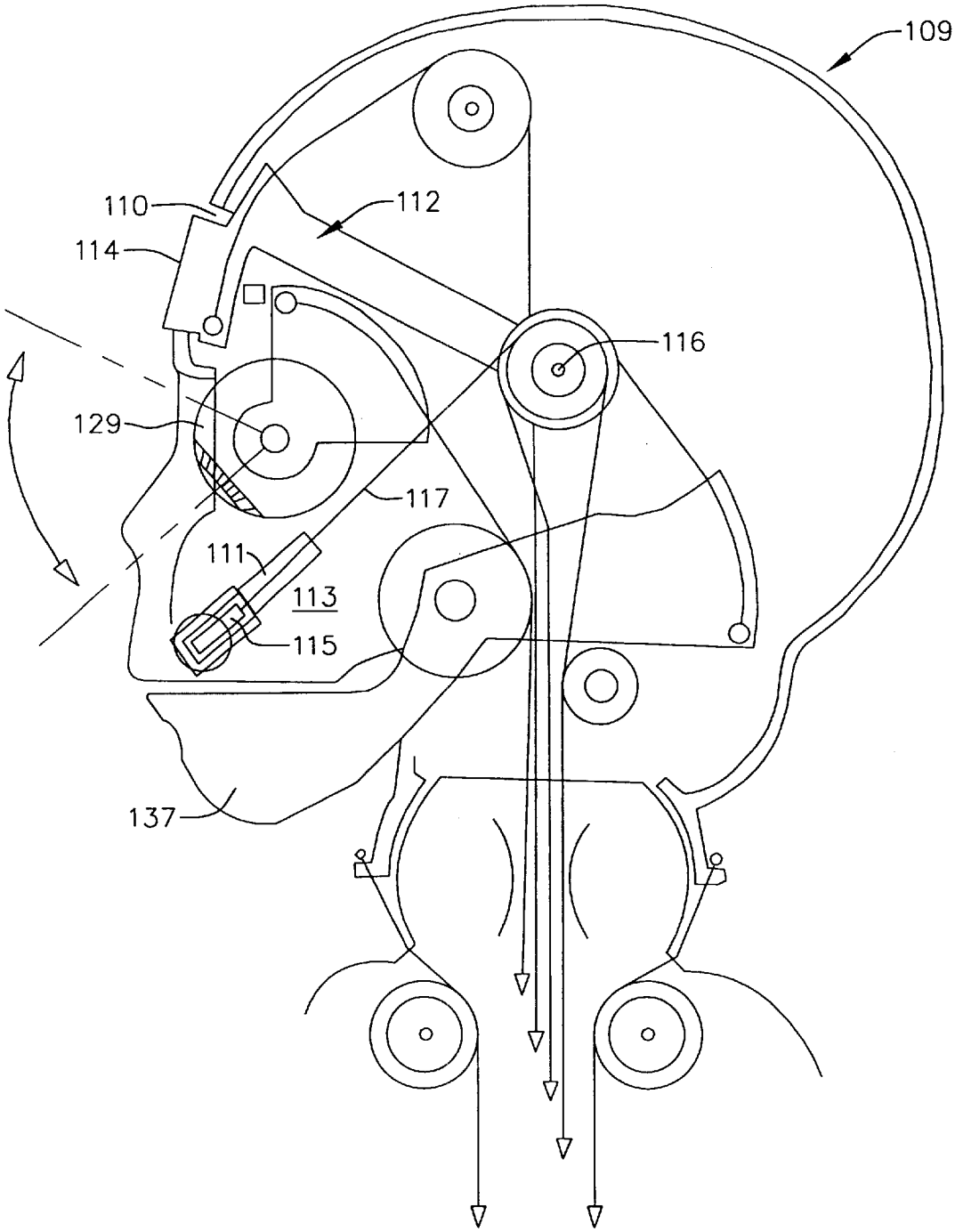
FIG. 9 is a side view of one embodiment skull structure for the exemplary baby doll.

In yet a further alternate embodiment, slots 111 may be formed in the cheek area 113 of the skull as shown in FIG. 9. A pad 115 is fitted and guided a the slot 111. The pad is spring loaded in first position (as for example shown in FIG. 9) and may be pulled by a line 117 to a second position. The skin is attached to each pad 115. As such as the pads move upward and downward within the slots so does the skin and thus the baby cheeks causing the baby to smile or have a sad face, respectively. With this embodiment, the geneva output gear 72 of the first geneva assembly 40(shown in FIG. 3A) drives the line 117 moving the pads 115 and thus, the cheeks of the baby doll.

Figure 7A:
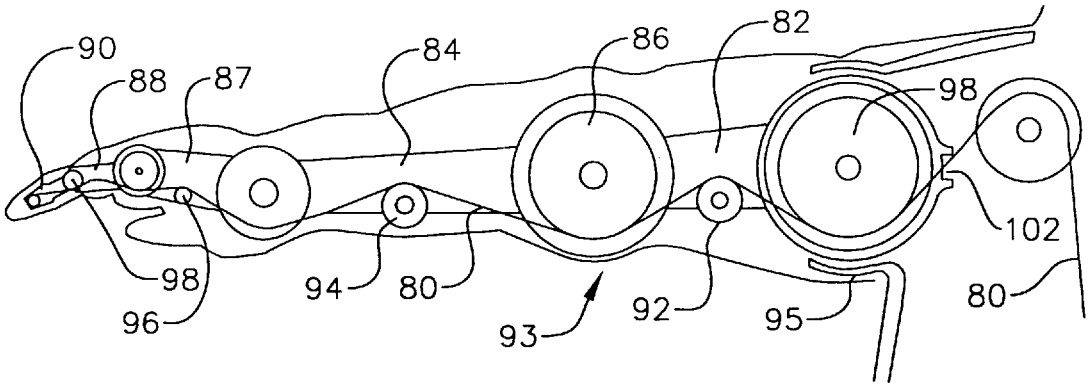
FIGS. 7A and 7B are bottom and side views, respectively of the structural members used to form the arm and hand of the exemplary baby doll.
Figure 7B:
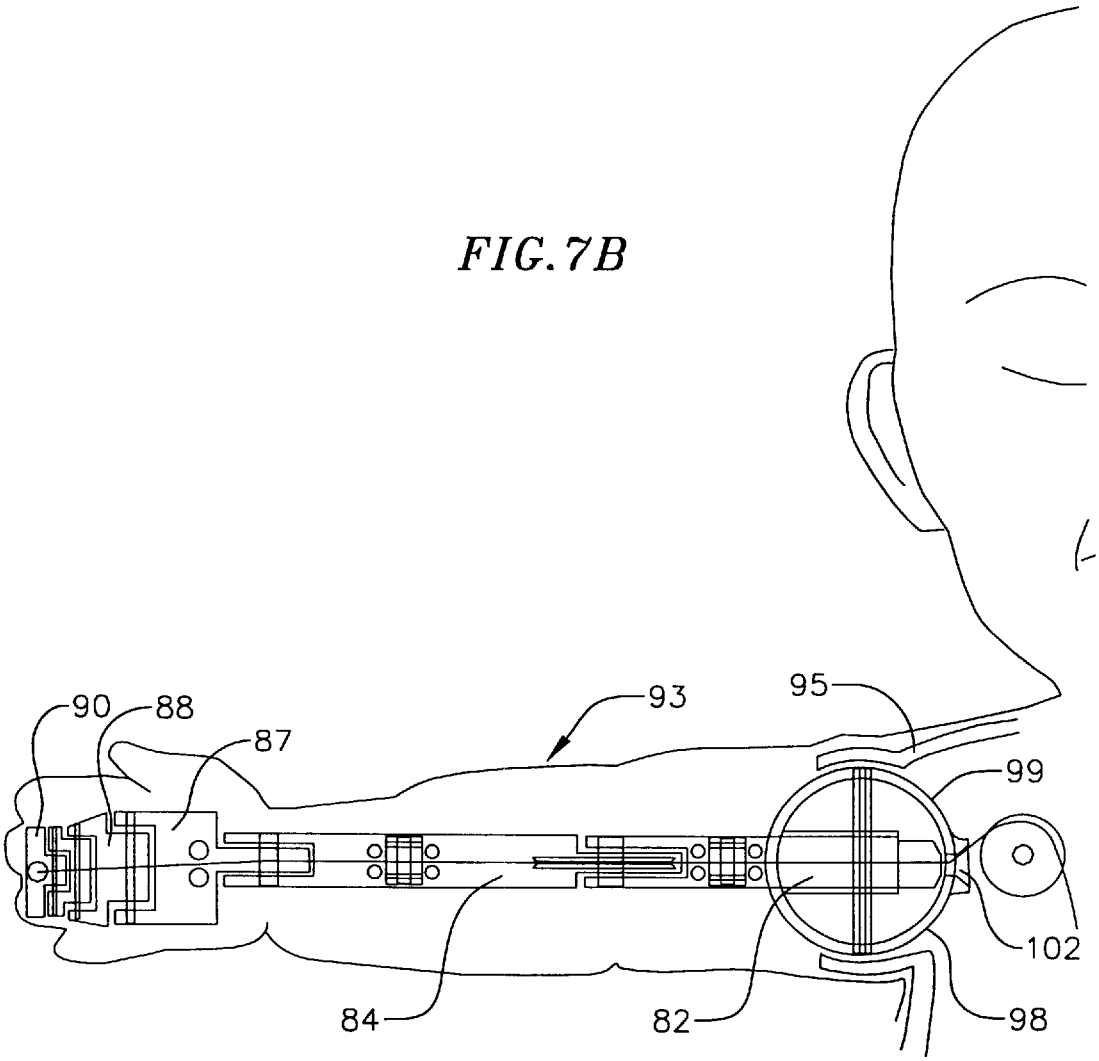
Figure 7C:
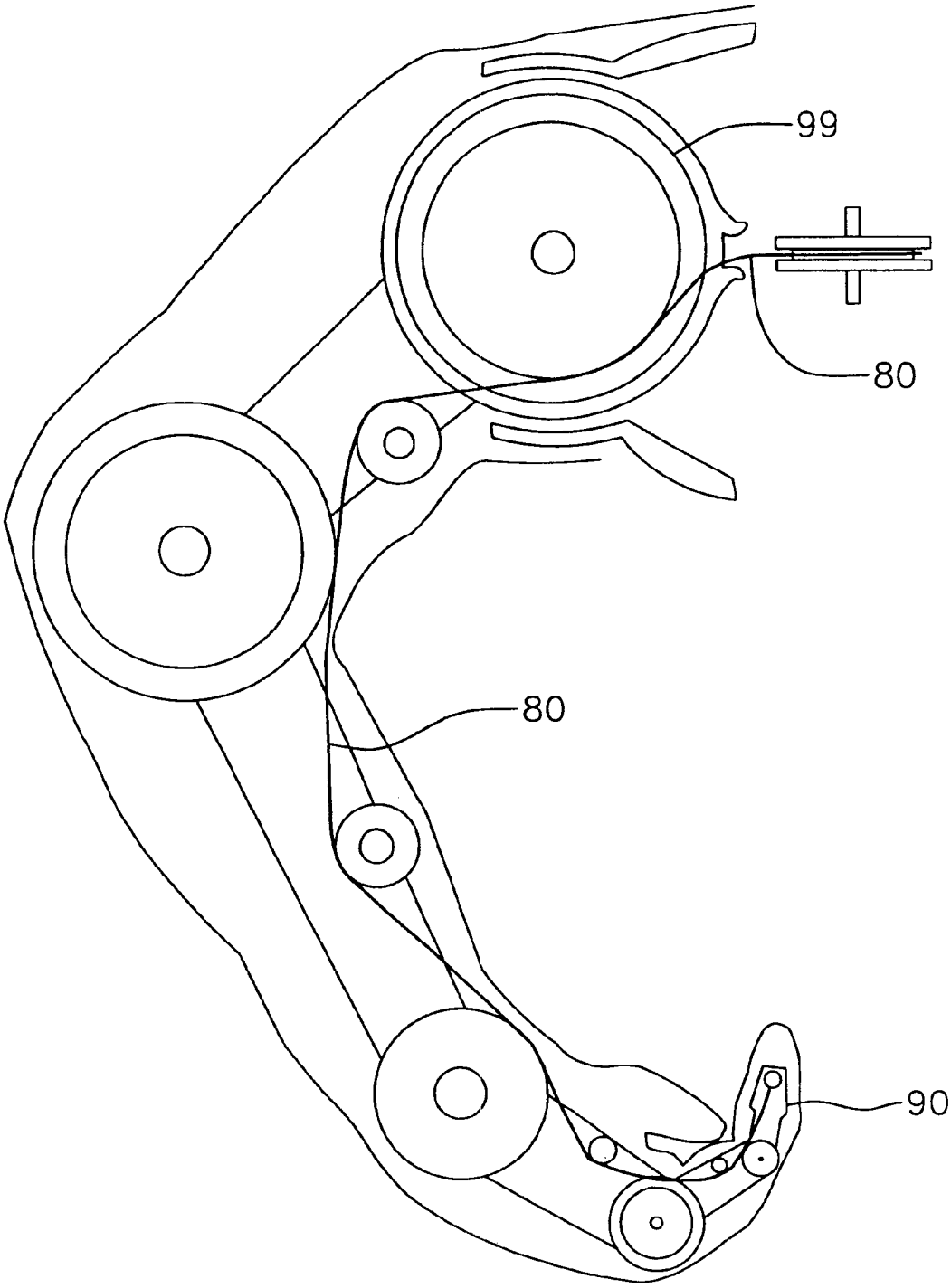
FIG. 7C depicts is a side view of the arm structural members of the exemplary baby doll with the arm and hand in a closed position.

To move an arm 93 of the baby doll, .a line 80 is used to bend and retract the arm as shown in FIGS. 7A and 7B. The baby's arm is composed of two members 82 and 84 pivotally coupled to each other by a coupling joint 86. The baby's hand is coupled to member 84 and consists of members 86, 88 and 90 which are sequentially and pivotally coupled to each other. An end of the line 80 is connected to the distal tip of hand member 90 and is guided by pulleys 98, 96, 94 and 92 as shown in FIG. 7A. As such, as the line is pulled it causes the members forming the hand to close forming a fist while also causing the arm to bend about pivot joint 86 as for example shown in FIG. 7C.

Figure 7D:
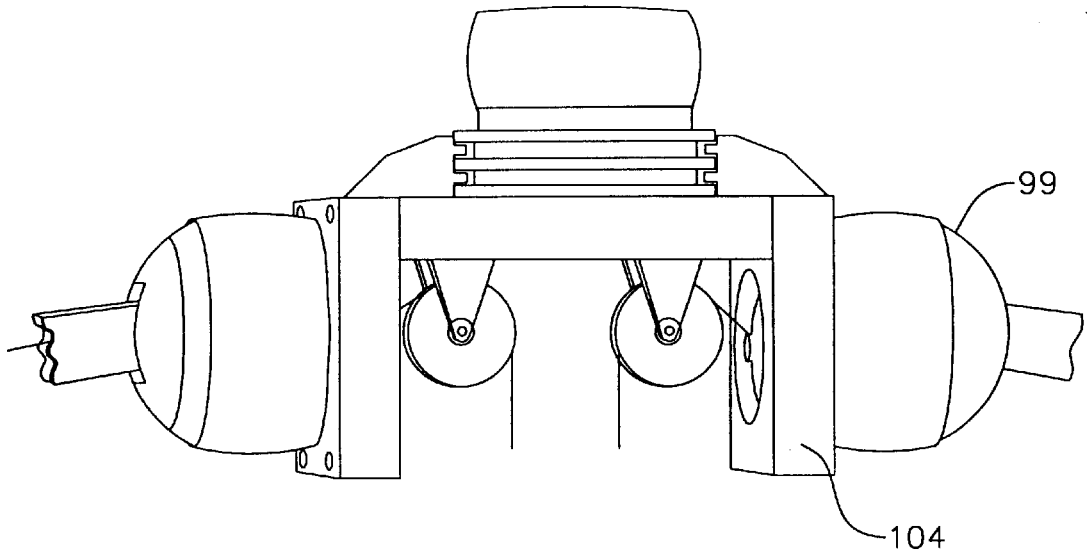
FIG. 7D is a perspective end view of a bracket with the arm structures of the exemplary baby doll connected to it.
Figure 8:
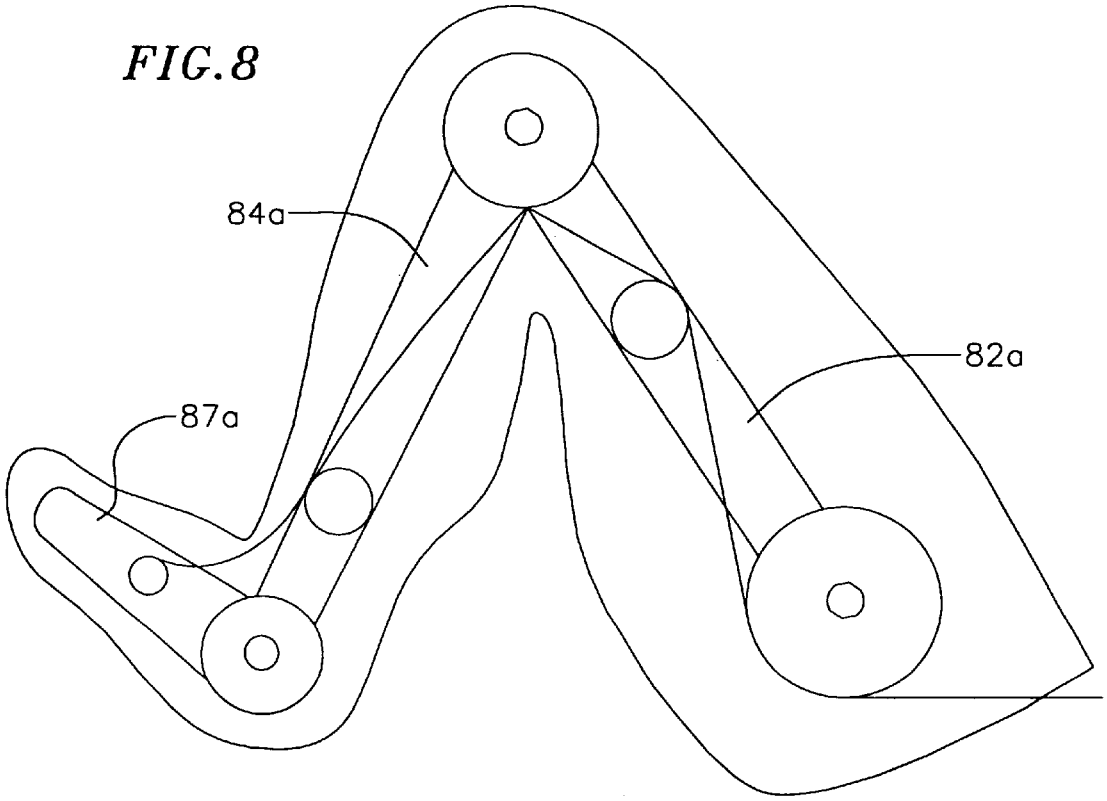
FIG. 8 depicts is a side view of the leg structural members of the exemplary baby doll with the arm and hand in a closed position.

Arm member 82 is pivotally coupled via a pivot 101 to a ball joint 99. In this regard, member 82 can rotate about its longitudinal axis as well as pivot. The ball joint is fitted to the upper torso 95 of the baby's body. To allow for the line 80, an opening 102 is formed in the ball joint 99. The ball joint of each arm is coupled to a bracket 104 as shown in FIG. 7D. It should be noted that the arm and hand pivot joints, (e.g., pivot joints 101 and 86) decrease in size (i.e., the size of the portion of the members forming the joint decrease in size) when progressing from the torso to the hand tips as shown in FIG. 7A. This decrease in the size of the pivots allows for a bending motion of the arm that simulates the bending motion of a human baby's arm. The baby's legs have similarly coupled members 82*a*, 84*a*, and 87*a* and operate in a similar fashion as the arms as shown in FIG. 8.

Use of the line instead of gears to drive the various structural members for moving the appendages such as the arms or the legs provide an advantage in that the legs and arms require fewer gears. By reducing the number of gears the opportunity for failure is reduced. Moreover, the lines allow a child playing with the baby doll to move the doll's arms and legs as for example by moving them in a direction compressing the lines or in a direction causing the lines to cause the pulleys to rotate relative to their corresponding output gear by overcoming the spring force by which the output gears are coupled to their pulleys.

To move the brows of the exemplary baby doll up or down, slots 110 are formed on the forehead of the baby's skull 109 at the location of the brows (FIG. 9). Cam members 112 having cam surfaces 114 are pivotally coupled within the skull of the baby and are able to rotate about a pivot 116 such that the cam surfaces 114 can move upward or downward within the slots formed on the baby's skull. The baby's skin is attached to the cam surfaces 114 such that as the cam surface moves upward or downward within the slots the skin and thereby the brows of the baby are moved upward or downward relative to the skull.

Figure 10B:
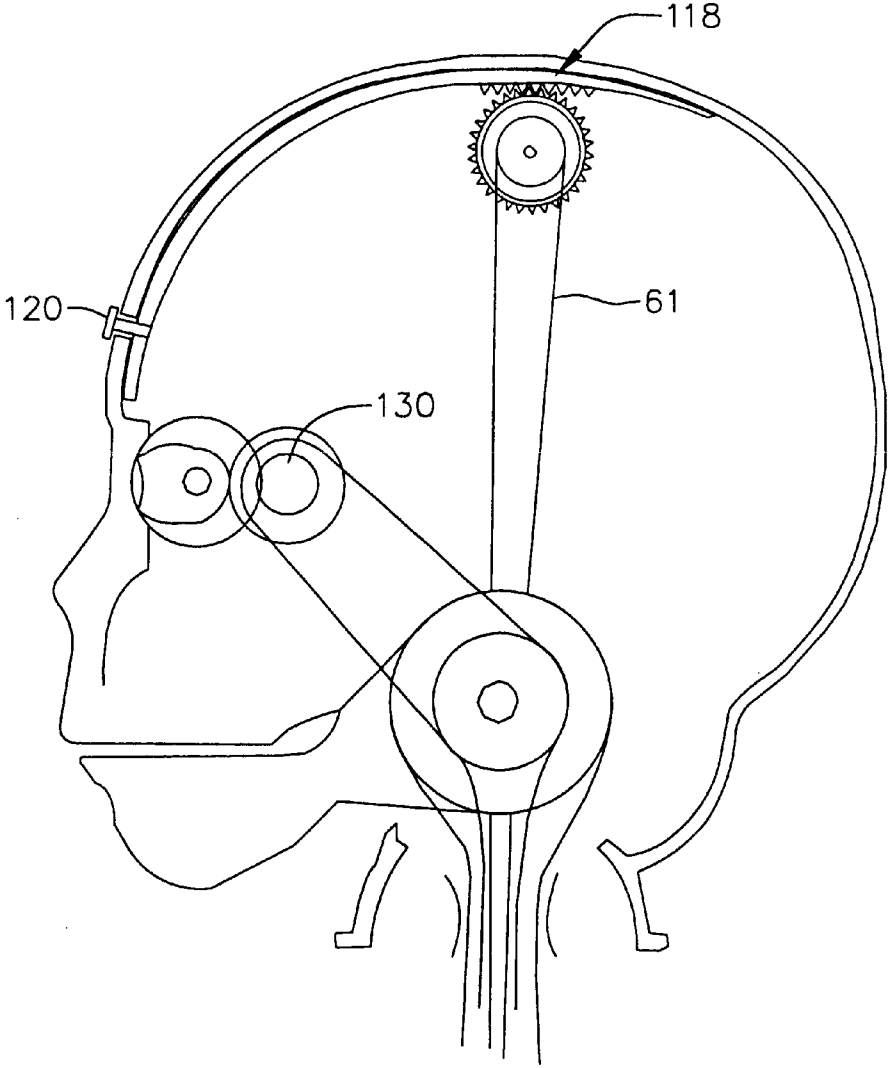
FIGS. 10A and 10B are front and side views , respectively of an alternate embodiment skull structure of the exemplary baby doll.
Figure 10A:
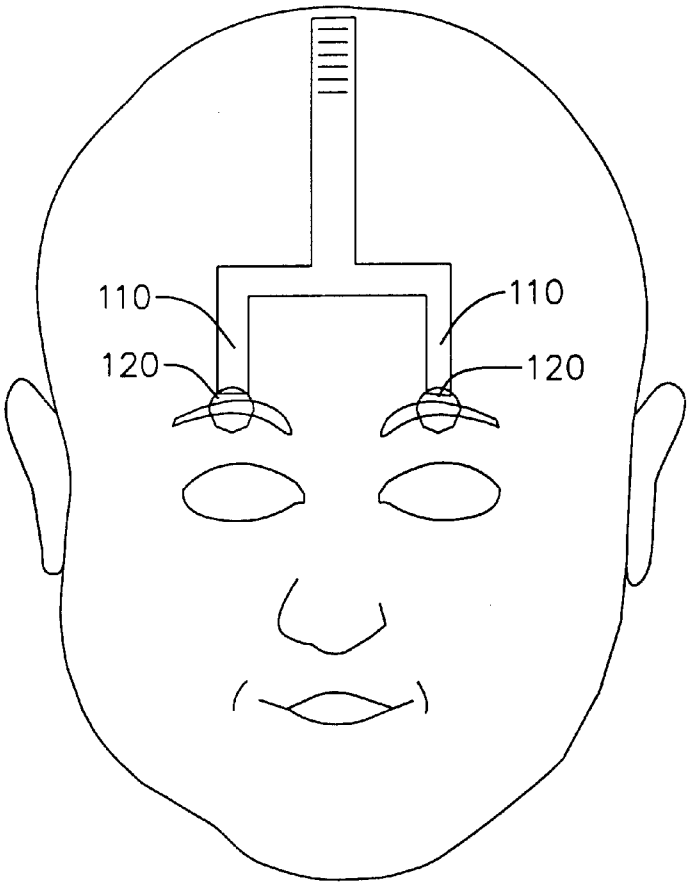

In an alternate embodiment, as shown in FIGS. 10A and 10B, a rack and pinion assembly 118 mounted within the skull is used to move a pin 120 fitted in each of the slots 110. The skin is attached to the pins 120. As such as the pins move upward and downward within the slots so does the skin and eyebrows. With assembly(shown in FIG. 3A) drives a pinion 122 which drives a forked shaped rack 124 via a line 61. A pin 120 is connected to each of the two forked ends of the rack.

Figure 11:
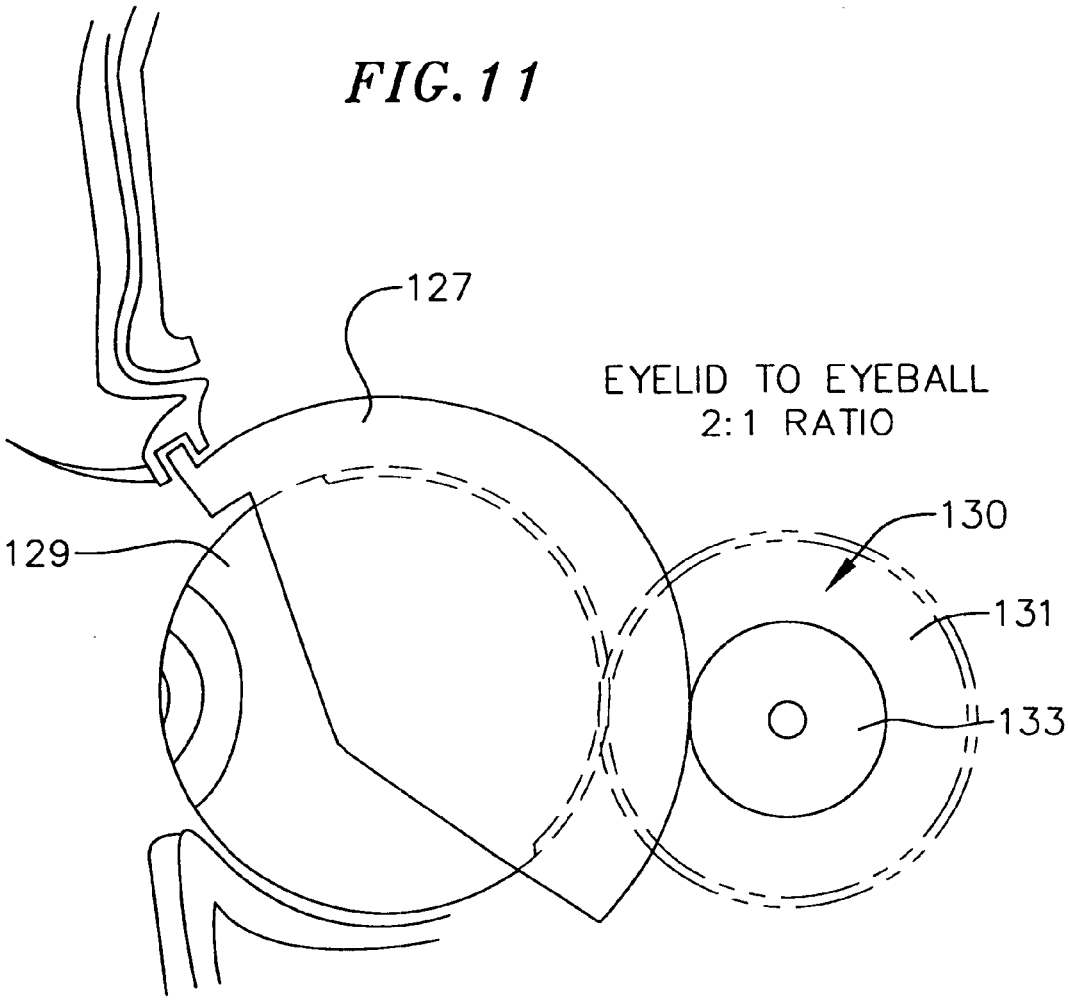
FIG. 11 is a side view of an exemplary compound gear assembly for driving the eyeballs and eyelids of the exemplary baby doll.

The eyelids 127 and eyeballs 129 are preferably rotated together at different rotational speeds. A compound gear 130 is used to rotate the eyelids and eyeballs at relative speeds as shown in FIG. 11. The compound gear is driven by the output gear 97 coupled driven by the third geneva assembly shown in FIG. 3A. Gear 131 of the compound gear is coupled to the eyeballs 129 while gear 133 of the compound gear is coupled to the eyelids 127. Preferably, a 2 to 1 ratio of rotation is used such that the eyelids rotate twice as much as the eyeballs for a given rotation of the compound gear. As such, the eyelids open twice as fast as the eyeballs rotate upward and similarly the eyelids close twice as fast as the eyeballs rotate downward. Because the eyelids move faster than the eyeballs and because they are made from a soft material, the eyelids tend to create folds as the eyes are opened much like the eyes of a real human baby. In an alternate embodiment, the eyelids are thin membranes which are at least partially adhered to the eyeballs. In this regard, as the eyeball with attached eyelids rotate to open the eyes, the eyelid skin gets tucked creating folds in the eyelid skin.

Alternatively, the eyeballs 129 may be pivotally coupled to the skull 109 and spring loaded in a closed position as for example shown in FIG. 9.

The jaw 137 is rotatably coupled to the skull and is rotated towards an open position or a closed position relative to the skull using a pulley system. In the exemplary embodiment, the jaw is driven by output gear 107 of the fourth geneva gear assembly 46 (shown in FIG. 3A).

Figure 12:
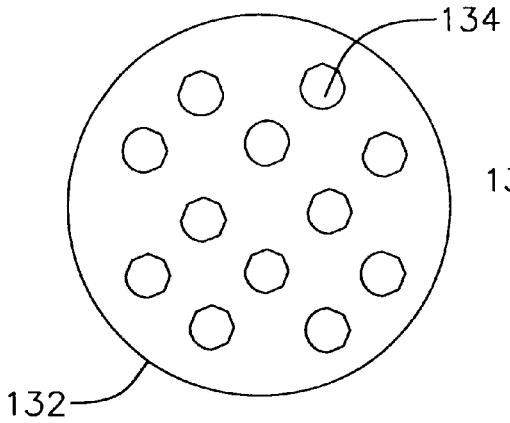
FIG. 12 depicts a top view of a line guide incorporated in the exemplary baby doll.
Figure 13:
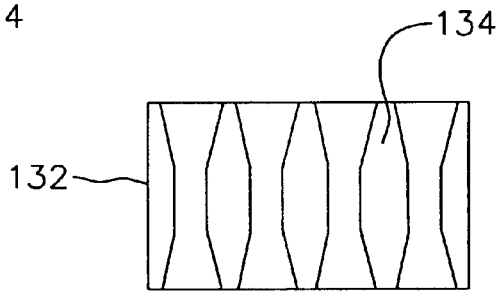
FIG. 13 is a cross-sectional view of the line guide shown in FIG. 12.
Figure 14:
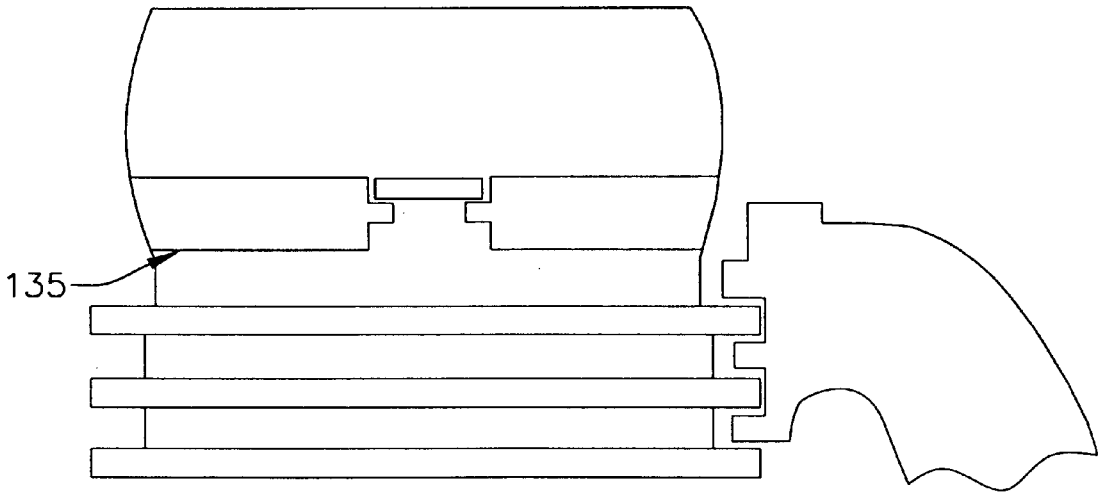
FIG. 14 is an end view neck joint structure of the exemplary baby doll.

All the lines going to the baby's head are routed through the baby's neck. A line guide 132 (FIGS. 12 and 13) comprising a plurality of openings 134 is fitted within the neck 135 (FIG. 14) of the baby doll for preventing the lines from getting tangles as the baby neck moves and/or rotates. Each line portion routed through the neck is fitted through an opening 134. Each opening 134 accommodates a single line portion. A typical neck joint is shown in FIG. 14. This neck joint allows the neck to rotate as well as tilt forward and backward. Preferably the neck is allowed to rotate up to ±45° from center, and to tilt up to ±35°.

In the exemplary baby doll, with the exception of the neck, a single line is used to move a part in one direction, while movement in the opposite direction is caused by the flexibility of the skin.

With the appropriate mapping of movements, the four geneva gear assemblies may be used cause the baby doll to have movements that simulate the movements and behavior of a human baby. For example, the baby may be made to act surprised, to act drowsy or to stretch as it is waking up.

The movements of the baby doll may be mapped differently than described above using the four geneva gear assemblies. Alternatively 5 or 6 geneva gear assembly may be incorporated for providing the baby doll with more individual movements.

It should be noted that the movements of the doll may be limited mechanically or through software. Programmable processor hardware such as chips are used to control the movement of the dolls by controlling the operation of the motors.

Figure 15A:
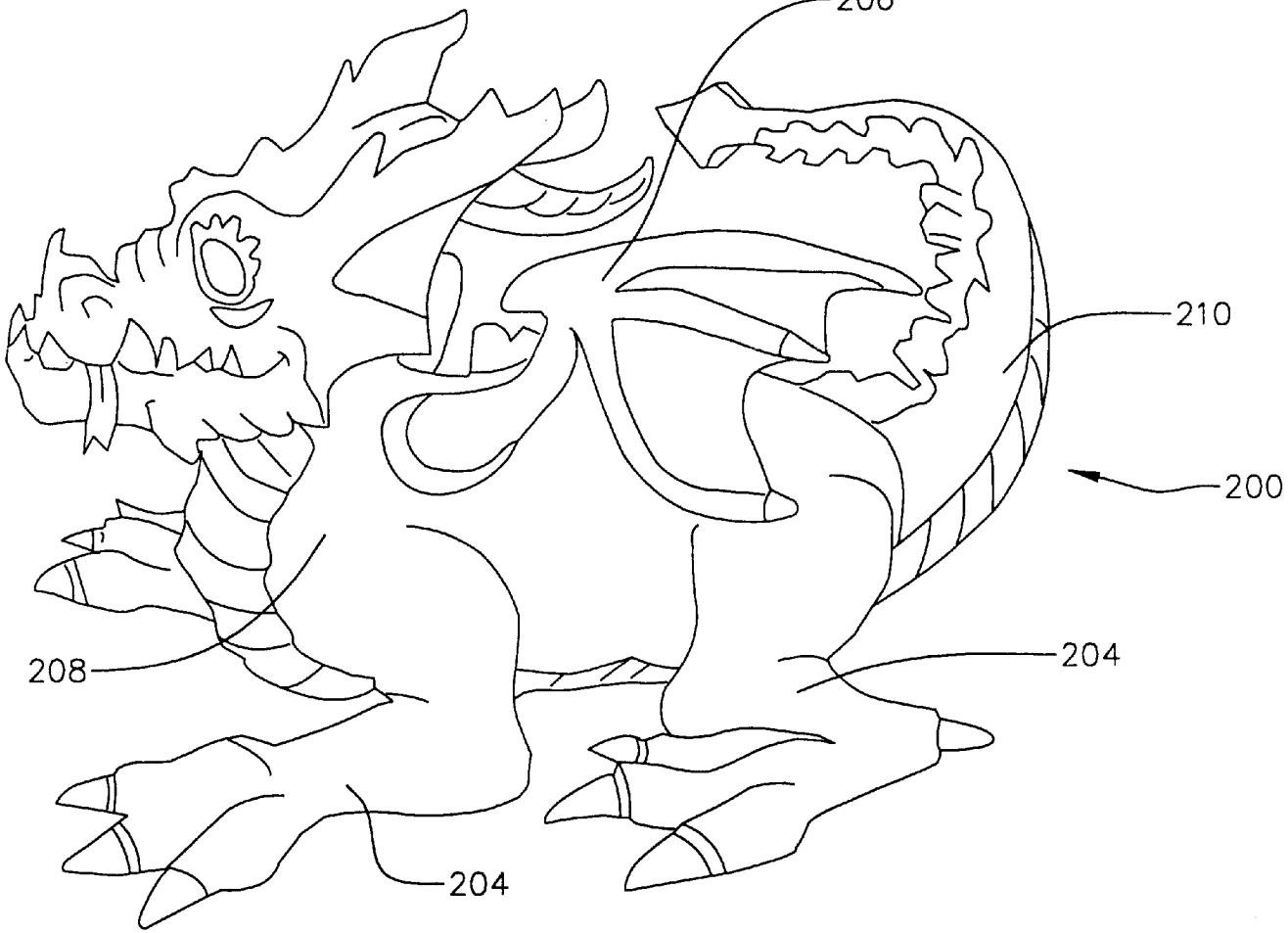
FIG. 15A. is a side view of an exemplary dragon toy of the present invention.
Figure 15B:
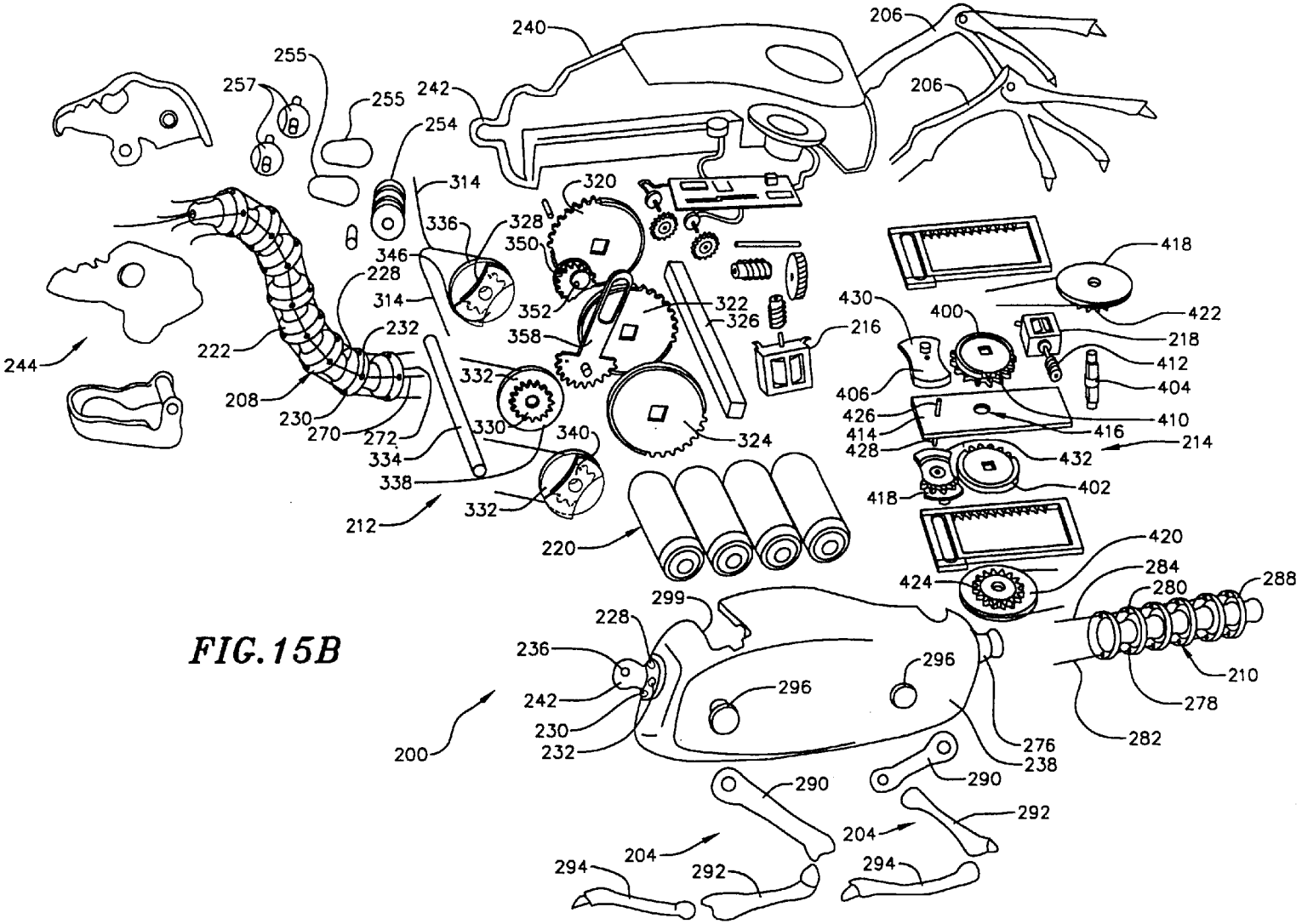
FIG. 15B. is an exploded view of the gearing and parts making up the exemplary dragon toy shown in FIG. 15A.

Another exemplary embodiment toy of the present invention is a dragon incorporating to geneva gear assemblies each driven by a separate motor to drive the neck, head, eyes, mouth, tail and wings of the dragon 200 (FIGS. 15A and 15B). The geneva assemblies provide for a fluid motion to these parts providing the dragon with realistic movement. In the exemplary dragon shown in FIGS. 15A and 15B, the dragon 200 comprises a body 202 from which extend four legs 204, two wings 206, a neck 208 and a tail 210. A head is attached to the neck. The body houses two geneva gear assemblies 212, 214 as well as two motors 216, 218 and batteries 220 for driving the geneva gear assemblies, respectively.

Figure 16A:
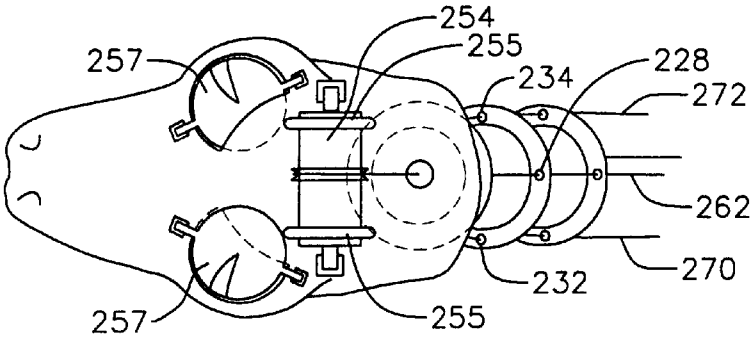
FIG. 16A is a top view of the structure forming the head and neck of the exemplary dragon toy shown in FIG. 15A.
Figure 16B:
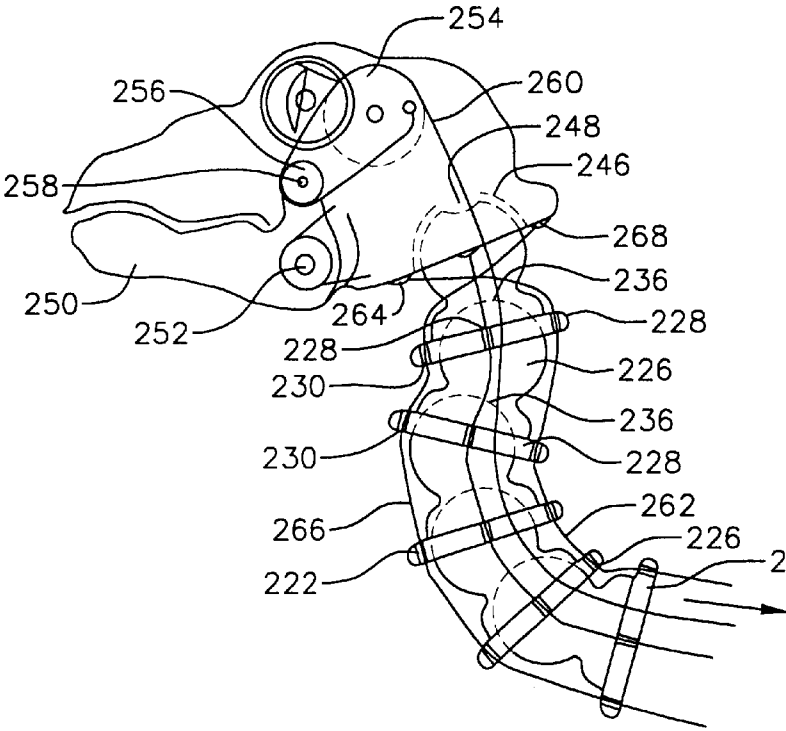
FIGS. 16B and 16C are side views of the structure forming the head and neck of the exemplary dragon toy shown in FIG. 15A with the jaw of the toy closed and open-, respectively.
Figure 16C:
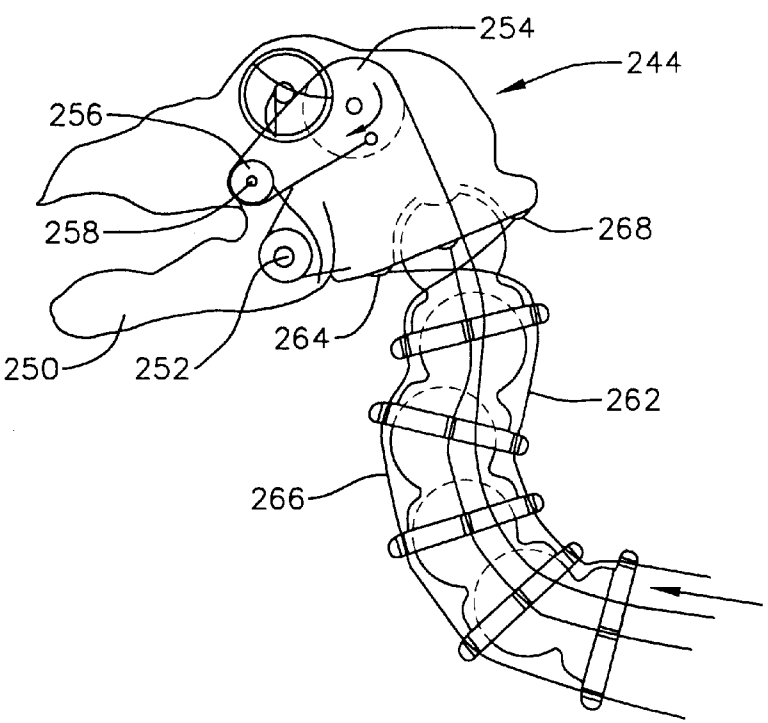

The neck 208 and tail 210 is formed by a plurality of interlocking bell-shaped members 222 (referred to herein as "bells" for convenience) having a cup portion 224 from which extends a flange portion 226, as for example shown in relation to the neck on FIGS. 16A, 16B and 16C. These bells are designed such that they can interlock with each other allowing each other to rotate and swivel relative to each other. Each of the bells has four openings 228, 230, 232, 234 formed through their flange portion, preferably equidistantly spaced apart. Furthermore, an opening 236 is formed through the apex of each bell.

In the exemplary embodiment shown in FIG. 15B, the body comprises two halve sections 238, 240 which mate together. A bell 242 complementary to the bells 222 for interlocking with the bells 222 extends from the forward end of the body. The bell 242 extending from the body also has four openings 228, 230, 232, and 234 formed through its flange portion and an opening 236 formed through its apex. These openings provide access from the interior of the body to the exterior of the body.

A bell 222 interlockingly "snaps" onto the bell 242 of the body. Another bell "snaps" onto the bell 222 interlocked with the body bell 242. By "snapping" a plurality of bells the neck of the dragon is formed. The four openings formed on the flange of each bell are preferably aligned with the four openings formed on subsequent bells.

The dragon has a head having a socket 246 complementary to the cup portion 226 of the bells 222. In this regard, the cup portions of the end most bell forming the neck can "snap" into the socket such that the head can move and swivel relative to the end most bell. An opening 248 is formed through the apex of the socket 246.

The head comprises a jaw 250 that is preferably spring loaded in the open position about a rotating axis 252. A first head pulley 254 is rotatably mounted within the head. A second head pulley 256 space apart from the first head pulley 254 is rotatably coupled to the jaw 252 for rotating about an axis 258 offset from the rotating axis 252 of the jaw.

A jaw control line 260 is fixed to the first head pulley 254, wound around the second head pulley 256 and wound around the first head pulley 254 and extends through the openings 248 and 236 formed through the socket 246 and bells 222 and 242 respectively. A neck up line 262 is fitted through each upper opening 228 formed on the flange portions of the bells 222 and 242. The neck up line is fitted first through the flange portion of the end most bell interfacing with the head socket and then through the corresponding openings in each consecutive bell forming the neck and into the body. In the exemplary embodiment shown in FIGS. 16B and 16C, the end of the neck up line protruding through the end most bell interfacing with the socket is fixed to the head at a location 264 below the end most bell. In this regard, pulling of the neck up end line will cause the neck to curve upwards and the head to rotate downward.

Similarly, a neck down line 266 is threaded through the bottom openings 230 of the flange portions of the bells and into the body. The neck down line is fixed to the head at a location 268 above the end most bell interfacing with the socket. In this regard, pulling of the neck down line will cause the neck to bend downward and the head to rotate upward. Furthermore, a neck right line 270 and a neck left line 272 are formed through the left openings 232 and through the right openings 234, respectively and into the body of the dragon.

In the exemplary embodiment toy shown in FIGS. 15B and 16A, the ends of the first head pulley are fitted with rubber O-rings 255. Two eye-ball 257 are each pivotally mounted on the head and are each in frictional contact with a rubber O-ring 255 such that rotation of the first head pulley causes rotation of the eye balls. In this regards, the eyes appear open when the first head pulley rotates in a first direction and appear closed when the first head pulley rotates is a second opposite direction.

The terms "up", "down", "left", and "right" are used for descriptive purposes only for describing the dragon movements as viewed from a location at the rear of the dragon.

The tail of the dragon is also formed by bells 222 that are mounted to a rear bell 276 extending from the rear-end of the dragon body. The bells 222, 276 used in the exemplary dragon shown in FIG. 15B have two openings equidistantly spaced apart formed on each of their flange portions. On the exemplary embodiment shown in FIG. 15B, when viewed from the rear, there is an opening 278 formed on the left and an opening 280 formed on the right of each flange portion of each of the tail bells and the bell extending from the body. A tail left line 282 and a tail right line 284 are fitted through the corresponding left and right openings 278, 280 formed on the flange portions of the bells. A knot or a ball may be attached to the end of the lines penetrating the end most tail bell 288 for retaining an end of each line at the end most bell.

In the exemplary embodiment shown in FIGS. 15A and 15B, four legs 204 (only two of which are shown in FIG. 15B) each comprising three members 290, 292 and 294 are pivotally coupled to the body via a pin 296. More specifically member 290 is pivotally coupled to the body. Member 292 is pivotally coupled to member 290. Member 294 is pivotally coupled to member 292.

Figure 17:
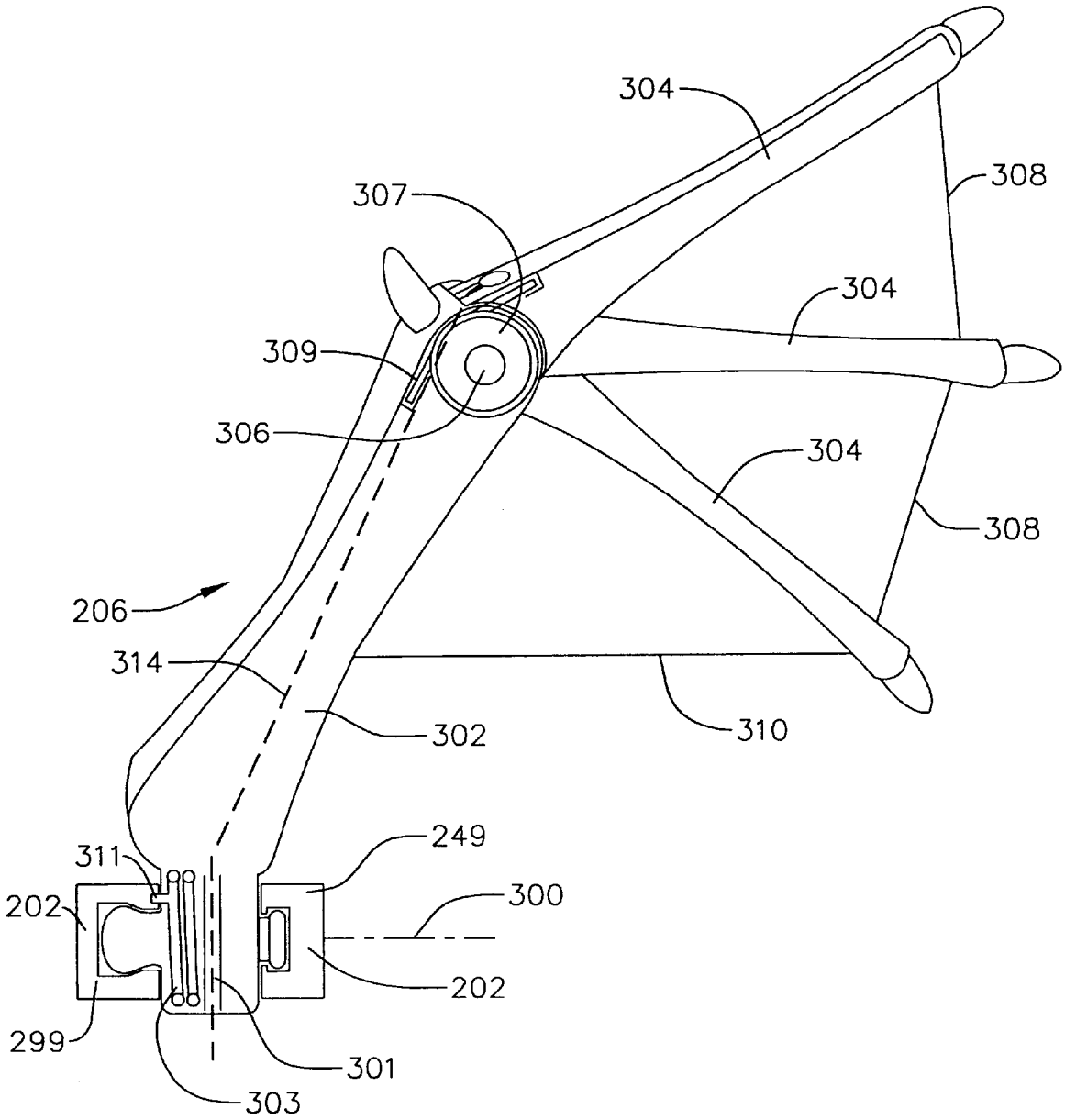
FIG. 17 is a side view of the structure forming a wing of the exemplary dragon toy shown in FIG. 15A.

A pair of wings 206 are each rotatably coupled to the body upper portion 299 about a pivot axis 300 (FIGS. 15B and 17). Because both wings are identical, only one is described herein. Each wing comprises a body portion 302 which is pivotally spring coupled to the body about the pivot axis 300 via a pulley 301 and a spring 303 which has an end 311 fixed to the dragon body 202 and an end fixed to the pulley 301. Three arm portions 304 are pivotally coupled to the body portion about the same axis 306 via a pulley 307. The arms are spring coupled by a coil spring 309 wound around the pulley 307 such that they are spring loaded in a spaced apart position relative to each other and relative to the body. One end of the spring 309 extends into an arm while the other end of the spring extends into the body portion of the wing. The ends of the arms distally away from the body portion are interconnected with a line 308. A line 310 is used to connect one arm to the body portion. Instead of lines a webbing may be formed between consecutive arms and between an arm and the body portion. A pulley 312 is formed in the base of the body portion whose axis is. coaxial with the pivot axis 300.

A wing line 314 is fixed to the arm pulley 307 and extends within the body portion of the arm and is wound on the pulley 301 and extends into the body of the dragon. By pulling on the wind line 314 from a location within the dragon body, the arm pulley 307 is caused to rotate against the spring force generated by the spring 309 and cause the arms to rotate toward each other while at the same time causing the body portion of the wing to rotate about the rotation axis 300 against the spring force generated by spring 303.

Figure 18A:
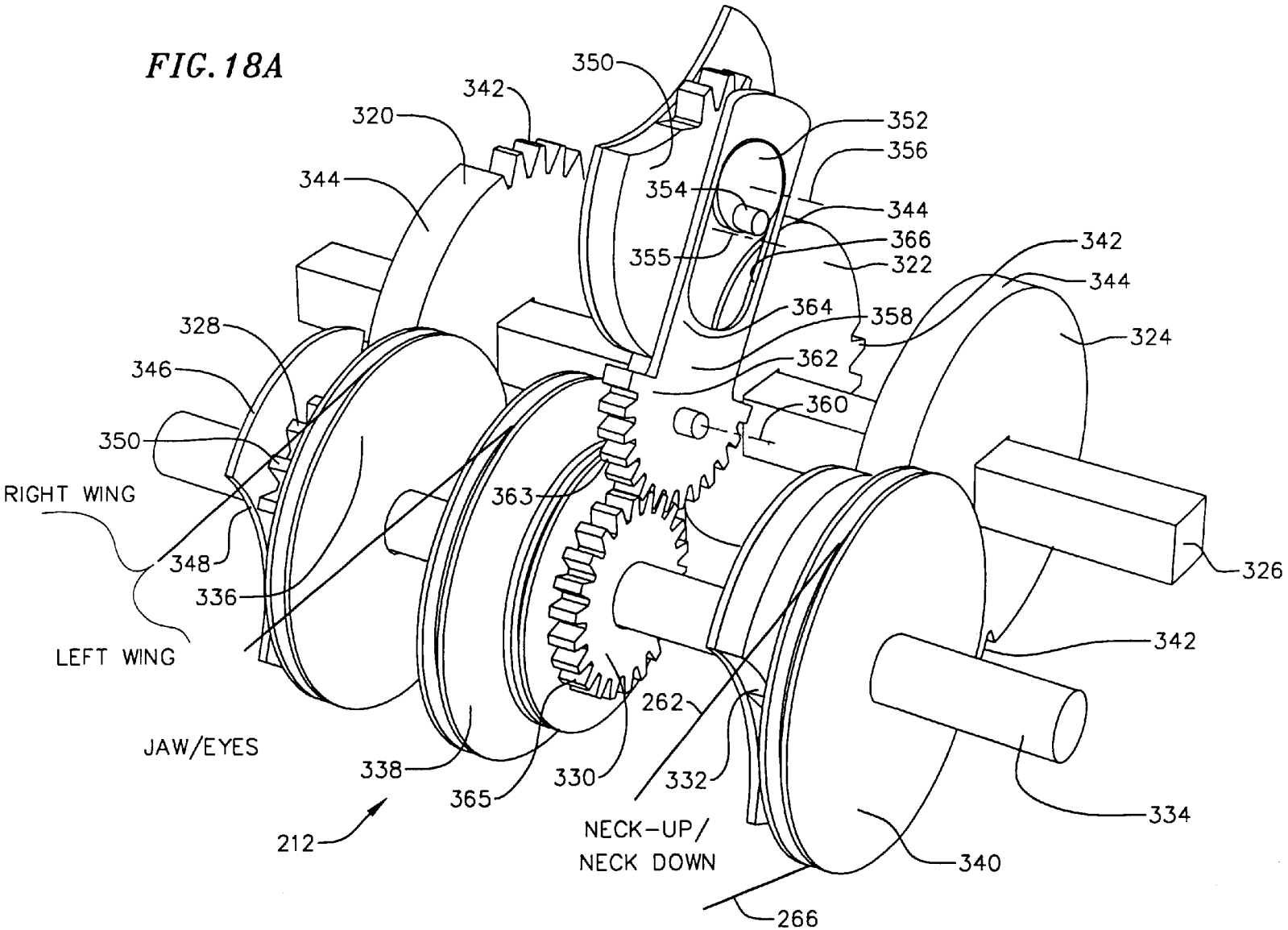
FIGS. 18A and 18B are front and rear perspective views, respectively of one of the geneva gear assemblies incorporated in the exemplary dragon toy shown in FIG. 15A.
Figure 18B:
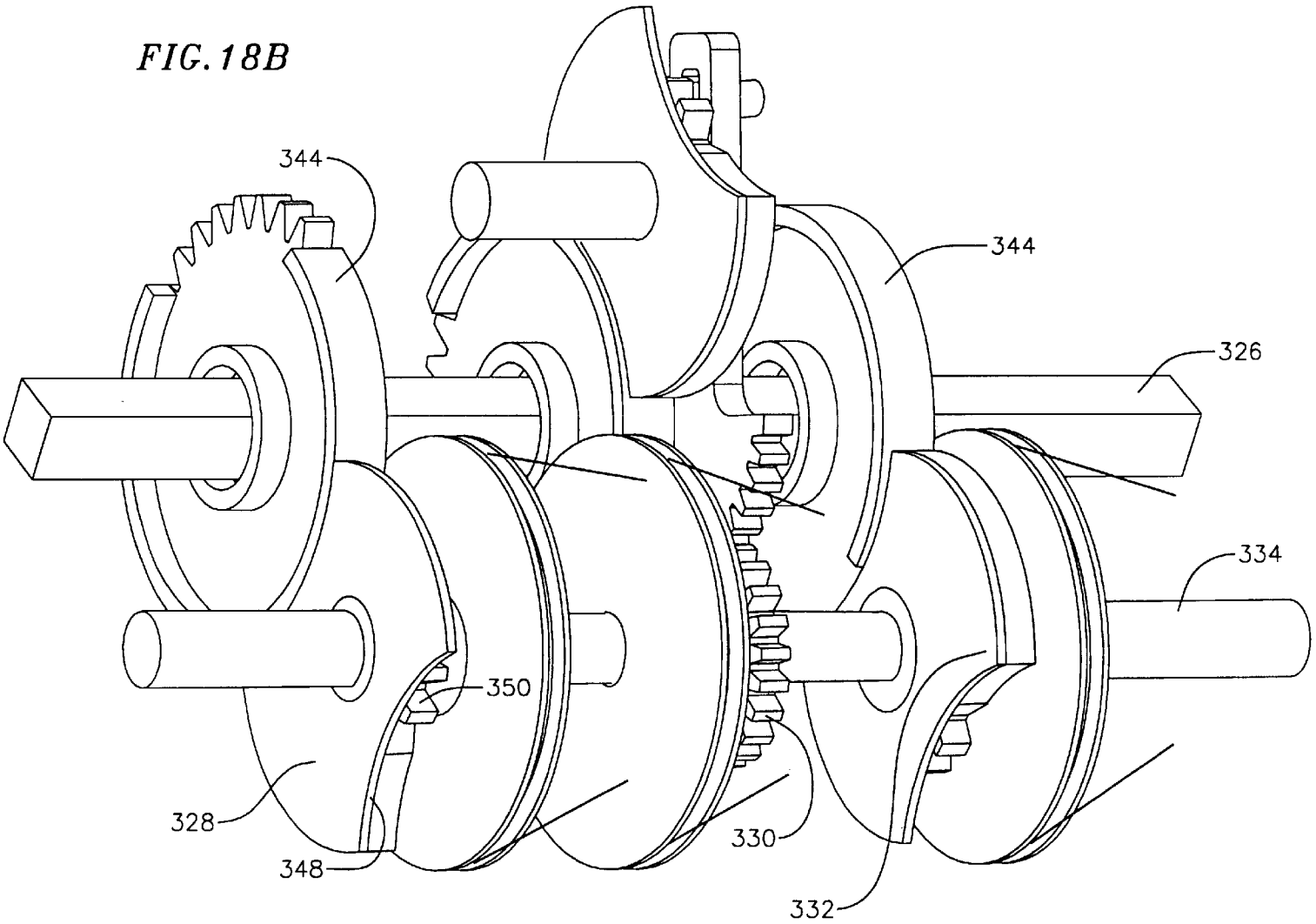

In the exemplary embodiment toy shown in FIG. 15B, a first geneva assembly 212 is mounted in the dragon body 202 and comprises first, second, and third drive gears 320, 322, 324, respectively, driven by a motor 216 via a drive shaft 326 and a first, second and third output gears 328, 330, 332, respectively, that are free to rotate about and not with an output shaft 334 (FIGS. 15A, 18A and 18B). First, second and third pulleys 336, 338, 340 are coaxially coupled to respective first, second and third output gears 328, 330, 332. Preferably, the pulleys are spring coupled to each of the output gears.

In the shown exemplary embodiment, the drive gears are fixedly coupled to the drive shaft 326. In this regard, as the drive shaft rotates so do the drive shaft gears. The drive gears each have only gear teeth 342 formed on a portion of the gear circumference. An arcuate stop member 344 is defined on the remaining circumference. The arcuate stop member may be a circumferential member extending from the gear as for example shown in FIG. 18A or may be the outer surface of the drive gear periphery which does not comprise any teeth.

The first output gear 328 comprises a geneva gear follower portion 346 which in the exemplary embodiment shown in FIGS. 18A and 18B, is a plate-type member having two arcuate edges 348 opposite each other. Each of the arcuate edges has a curvature complementary to the curvature of the stop member 344 formed on the first drive gear. A gear portion 350 coaxially extends from the follower portion. As the first drive gear is rotated by the drive shaft, its stop member 344 rotates by the arcuate edge of the follower portion of the first output gear. When that occurs, the stop member of the first drive gear prevents the first output gear from rotating. As the drive gear continues to rotate, the gear teeth of the first drive gear which extend further radially than the stop member move past the follower portion and mesh with the output gear teeth. Simultaneous, the stop member moves past the arcuate edge of the follower of plate allowing the drive gear to rotate the output gear and thus the follower plate and pulley.

The length of the drive gear and output gear peripheries occupied by gear teeth is such that as the stop member is rotated to mate with the arcuate edge of the follower portion, the output gear is rotated by the appropriate distance to allow for such mating.

The third output gear 332 is the same as the first output gear and is in its position to be driven by the third drive gear 324. However, the location of the gear teeth of the third gear maybe offset from the location of the gear teeth of the first gears so to stagger the rotation of the first and third output gears as the gear shaft rotates.

In the exemplary embodiment shown in FIGS. 15B and 18, the second output gear 330 is mounted on the output shaft between the first and third output gears. A first intermediate output gear 350 similar to the first and third output gears is mounted on the body 202 of the dragon and is positioned to be driven by the second drive gear 322. A cam member 352 is pivotally mounted on the intermediate output gear about an axis 354 offset from the axis of rotation 355 of the first intermediate output gear. The cam pivot axis 354 is offset from the cam central axis 356.

A second intermediate gear 358 is pivotally mounted on the body 202 of the dragon about a rotation axis 360 offset and parallel from the axis of rotation 355 the first intermediate output gear and the second output gear. The second intermediate gear comprises a semicircular gear portion 362 having gear teeth 363 meshed with the gear teeth 365 of the second output gear 330. The rotation axis 360 of the second intermediate output gear is also the rotation axis of the semicircular gear portion 362.

An arm portion 364 extends from the semicircular gear portion of the second intermediate output gear. A slot 366 is formed within the arm portion. The cam 352 is confined within the slot. In this regard, as the first intermediate gear is driven to rotate by the second drive gear, it causes the cam move along generally circular path pivoting the arm portion 364 of the second intermediate gear back and forth about the rotation axis 360. Consequently, the semicircular gear portion rotates back and forth rotating the second output gear 330 and its corresponding pulley 338 back and forth. During one full rotation, i.e., 360° rotation of the first intermediate output gear 350, the second output gear 330 rotates in a first direction and then in an opposite direction.

In the exemplary embodiment shown in FIGS. 15A and 18, the lines 314 from the left and right wings are fixed to the first pulley 336 which coupled to the first output gear. In this regard, as the pulley rotates it pulls on the lines for closing and folding the wings. The neck up line 262 and the neck down line 266 are fixed in opposite relation to each other to the third pulley 340 which is coupled to the third output gear. In this regard, as the third output gear and thus the third pulley rotate in a first direction the neck up line winds around the third pulley while the neck up line and unwinds from the third pulley causing the neck to bend upward. As the third output gear and thus the third pulley rotate in a second direction opposite the first direction the neck down line winds around the third pulley while the neck down line. and unwinds from the third pulley causing the neck to bend downward.

The jaw control line 260 is fixed to the second pulley 338 which is coupled to the second output gear 330. In this regard, with the exemplary embodiment shown in FIG. 18, during a full revolution of the drive shaft 326, the wings can be retracted and folded, the neck may move upward (with the head rotating downward)and the jaw may close and open and the eyes may also close and open. When the motor turns the drive shaft in a reverse direction, the wings may be allowed to spring back to the original position of the mouth, the neck may move downward (with the head rotating upward)and the jaw may open and close and the eyes may also open and close. By offsetting the geared portions of each of the drive gears, the movement of the wings, jaw, eyes and neck may be staggered. Moreover, by moving the shaft only a portion of a turn such that only the geared portion of one of the drive gear meshes with its corresponding output gear, the member coupled to that output gear is only moved.

The second geneva gear assembly 214 comprises of first and second drive gears 400 and 402, driving by a drive gear shaft 404 and driving first and second corresponding output gears 406 and 408. In the exemplary embodiment shown in FIGS. 15B and 19, the drive and output gears are similar to the first and second drive and output gears of the geneva gear assembly 212. A gear 410 is attached to the drive shaft 404 and is meshed with a worm gear 412 driven by the motor 218 such that rotation of the worm gear by the motor causes rotation of the drive shaft and thus rotation of the drive gears.

Figure 19:
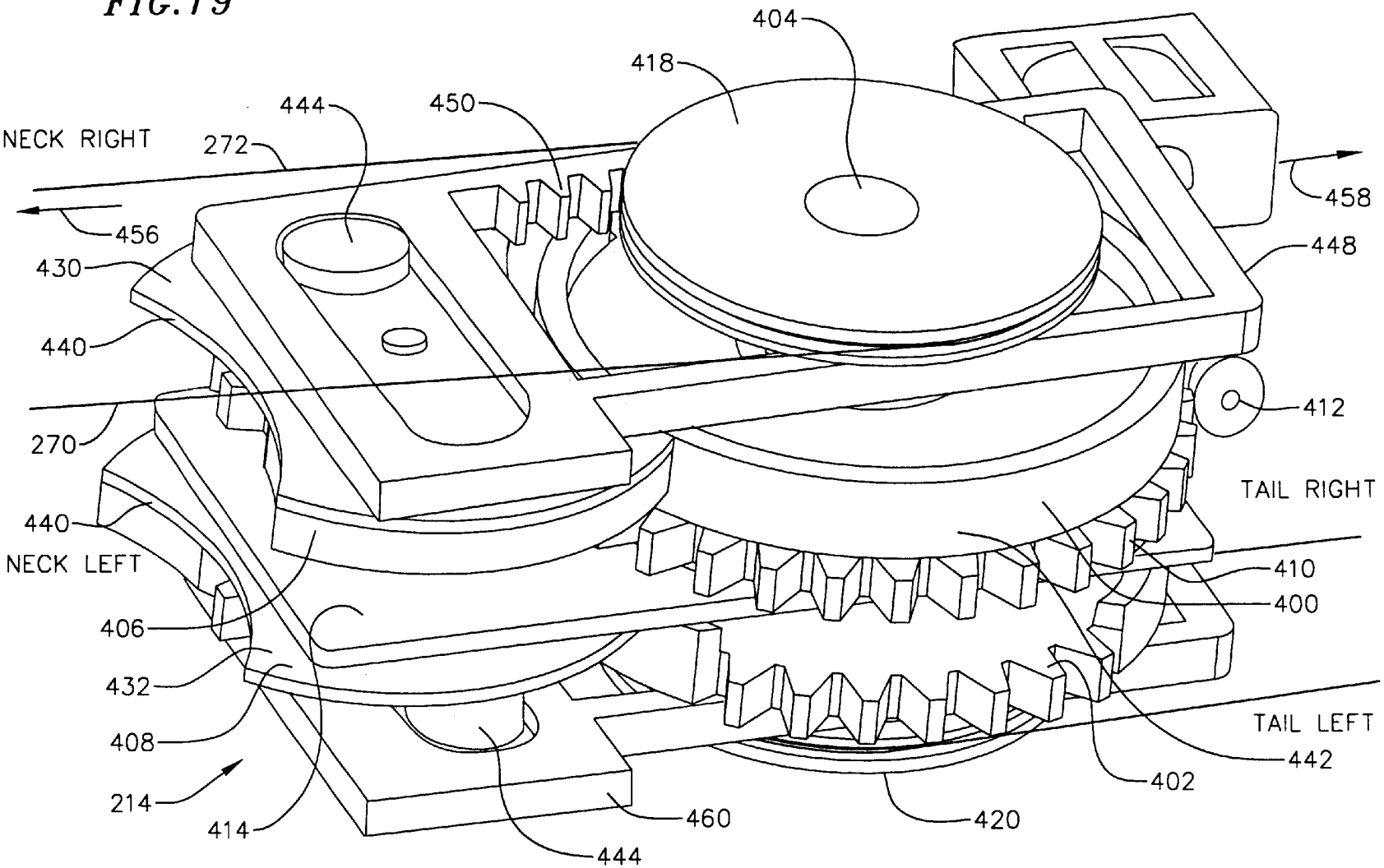
FIG. 19 is a perspective view of another of the geneva gear assemblies incorporated in the exemplary dragon toy shown in FIG. 15A.

In the exemplary embodiment shown in FIGS. 15B and 19, a gear plate 414 is positioned between the two drive gears and has an opening 416 which is penetrated by the drive shaft 404. A first pulley 418 is rotatably coupled to one end of the drive shaft. A second pulley 420 is rotatably coupled to the other end of the drive shaft. In other words, the pulleys can rotate relative to the drive shaft. Stated differently, as the drive shaft rotates the pulleys do not have to rotate. A gear 422 and 424 extends coaxially from each pulley 418, 420.

Two stub axles 426, 428 extend from opposite sides of the gear plate. In the exemplary embodiment, each output gear 406, 408 has a follower plates 430. Each out gear is rotatably coupled to a stub axle. When mounted on the stub axles, the output gears are in position to be driven, i.e., rotated by a corresponding drive gear. The follower plates of the exemplary embodiment geneva gear assemblies have two opposing curved edges 440 complementary to the curvature of the stop surfaces 442 of the drive gears. In this regard, while the stop surface of a drive gear moves past the curved edge of the follower plate, the output gear does not rotate. When the drive gear piece teeth mesh with the gear teeth of the output gear, the stop surface 442 moves past the curved edge 440 of the follower allowing the output gear to rotate.

A cam 444 extends from each of the output gears and are offset from the stub axles 426, 428. A first frame gear 448 having gear teeth 450 formed on an inner edge defining a rack type gear is fitted between the first pulley 418 and the first drive gear 400 such that the gear teeth 450 of the frame gear are meshed with the gear 422 extending from the first pulley. A slot 454 is formed through the frame gear end and is penetrated by the cam extend 444 extending from the first output gear 430 coupled to the first drive gear 400. The first frame gear is guided within the body of the dragon it can translate in the first direction as shown by arrow 456 and a second opposite direction as shown by arrow 458 in FIG. 19. In this regard as the first drive gear meshes and rotates the first output gear, the output gear rotates the cam about an arc which causes the frame to translate in a direction and then in an opposite direction. When this occurs, the gear teeth 450 of the frame gear which are meshed with the gear 422 extending from the first pulley cause the first pulley to rotate in a first direction and then in an opposite direction. A second frame gear 460 is similarly coupled to the gear 424 extending from the second pulley 420 and is driven by the cam 44 extending from the second output gear 408.

In the exemplary embodiments shown in FIGS. 15B and 19, the neck left line 270 and the neck right line 272 are fixed to the first pulley in opposing relationship. The tail left line 282 and the tail right line 284 are fixed to the second pulley in opposing relationship. Instead of two separate lines, the neck left and right lines may be one continuous line that may be fixed at a point on the first pulley while the tail right and left lines may be a single line that is also fixed at one point on the second pulley. By rotating the drive shaft and thus, the first drive gear, one of the neck lines is wound while the other is unwound allowing the neck to bend in one direction, while rotation of the first drive gear in an opposite direction will cause the neck to bend in the opposite direction. Similarly, by rotating the drive shaft and thus, the second drive gear, one of the tail lines is wound while the other is unwound allowing the tail to bend in one direction, while rotation of the second drive gear in an opposite direction will cause the tail to bend in the opposite direction. By controlling the location of the gear portions of the drive gears, the sequencing of the movement between the neck and the tail can be controlled.

As can be seen in the exemplary toy dragon, with two motors, a multitude of movements can be controlled so as to simulate the movements of a real dragon. Moreover, by providing the dragon with a controller as for example a computerized controller, the movements can be programmed as for example by controlling the amount and direction of rotation provided by each of the motors. The entire dragon may be covered by a flexible skin and colored appropriately.

Figure 20:
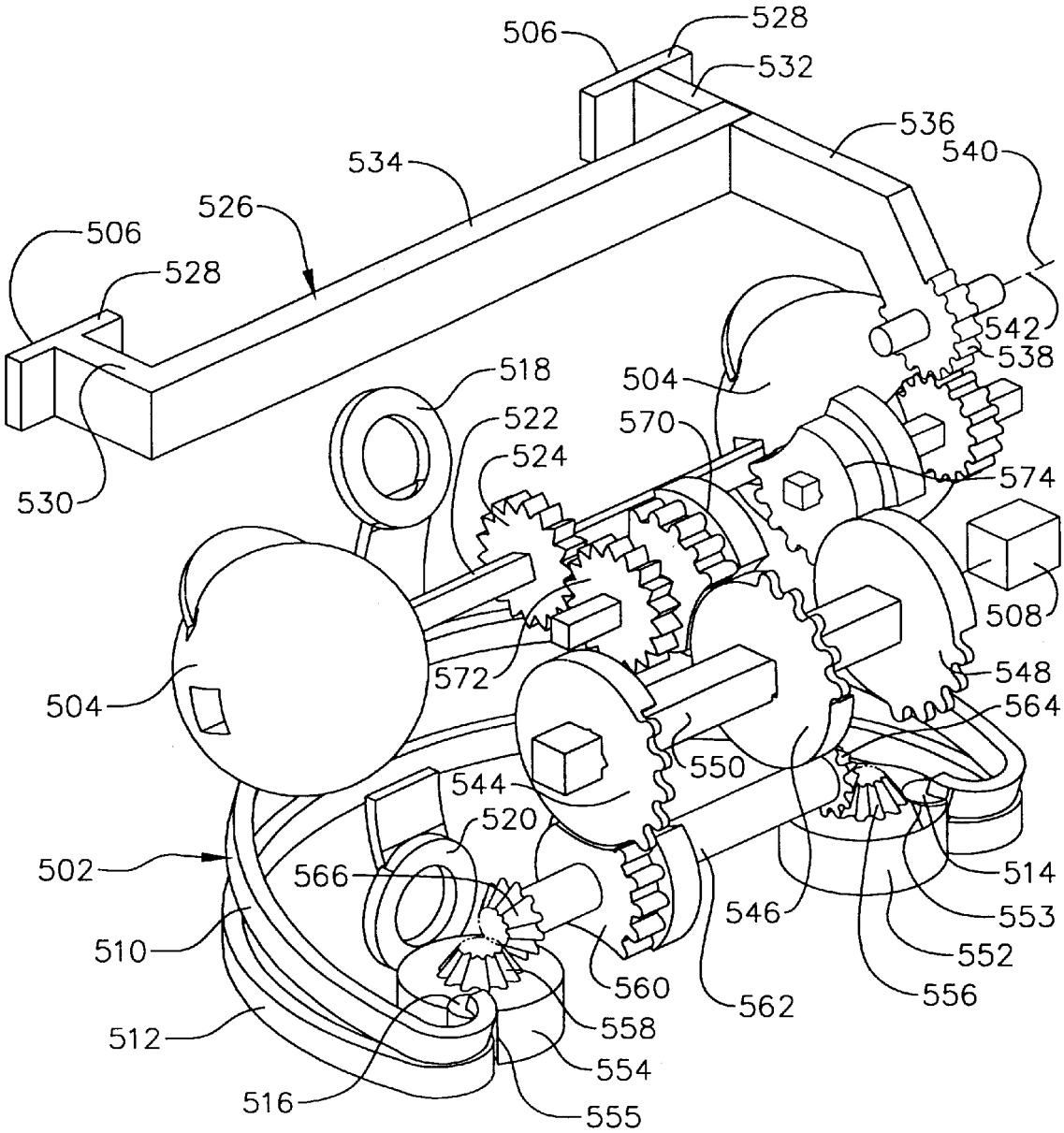
FIG. 20 is a perspective view of another geneva gear assembly for moving the head features of an exemplary toy of the present invention.

Another exemplary embodiment toy of the present invention incorporates an inventive geneva gear assembly as shown in FIG. 20 for moving the head features of the toy. The toy can be any animal-like or human-like figure having a face structure having flexible skin. The exemplary geneva assembly is able to control the movement of the mouth 502, the eyes 504 and the brows 506 of the figure using the single motor 508. In the exemplary embodiment shown in FIG. 20, the mouth 502 of the figure is formed out of a plastic material as a single unit having an upper portion 510 and a lower portion 512 which are typically aligned with the upper and lower lips of the figure, respectively. The ends of the upper and lower portions curve inward and culminate in common cylindrical members 514. In other words, the right side of the upper and lower portions end in a common cylindrical member 514 and the left ends of the of the mouth upper and lower portions also end in a cylindrical member 516. In its free state, the mouth is in an open position, i.e., the mouth upper portions is angled away from the mouth lower portion. Extensions 518 and 520 may extend from the upper and lower portions, respectively for attaching to the material forming the skin surrounding the mouth of the figure so as to create movement of such skin when the mouth opens and closes.

The eyeballs 504 are interconnected to each other via an eyeball shaft 522 which is driven by an eyeball gear 524 mounted on the eyeball shaft between the two eyeballs. The eyebrows 506 of the figure are made to move using a brow moving structure 526. In the exemplary embodiment shown in FIG. 20 the brow moving structure is channel shaped structure having two legs 530, 532 interconnected by a beam 534 and having a pad 528 extending from each leg 530, 532. Each of the pads is attached to the material forming the skin of the figure behind a corresponding brow 506. A drive leg portion 536 extends opposite from one of the legs 532. In the shown exemplary embodiment, the leg portion 536 has an end defining a generally circular gear section 538. The drive leg portion is pivotally coupled to the figure about a pivot axis 540 coincident with the rotational axis 542 of the circular gear section 538. In this regard, as the structure pivots about the pivot axis, it causes movement of the brows in an upward or downward direction. The mouth, eyeballs, and brows, are driven by first, second and third drive gears, 544, 546, 548 driven by a drive shaft 550 driven by the motor 508.

Two cylindrical mouth gear members 552, 554 each having a bevel gear 556, 558 extending from an end surface of the mouth mother member and each having a cylindrical opening 553, 555 formed near or tangential to the mouth gear member outer surface are coupled to the cylindrical members 516, 518 of the mouth. The cylindrical openings 553, 555 are complementary to the cylindrical members 514, 516 formed at the ends of the mouth structure. Each cylindrical member 514, 516 is fitted in a corresponding cylindrical opening 553, 555 in a corresponding mouth gear member.

A first output gear 560 is fixed on a first output shaft 562. A bevel gear 564, 566 is formed at each end of the first output shaft. One shaft bevel gear 564 is meshed with the bevel gear 556 on one mouth gear member. The other shaft bevel gear 566 is meshed with the bevel gear 558 extending from the other mouth gear member. The first output gear is positioned to and driven by the first drive gear 544. The first output shaft is also restrained for maintaining engagement of its bevel gears with their corresponding bevel gears formed on the mouth gear members. When the first drive gear drives the first output gear in a first direction it causes the first output shaft to rotate in a direction which causes the mouth gear members to rotate in a direction pulling on the cylindrical end members and curling the curving end portions of the mouth further inward causing the upper and lower mouth portions to move toward each other and the mouth to close. Rotation of the first output shaft in the reverse direction will cause the release the curling of the mouth ends and the mouth will open. Movement of the mouth will also cause movement of the skin surrounding the mouth which is,fixed to the extensions 518, 520 extending from the mouth upper and lower portions, respectively.

A second output gear 570 is coupled to the second drive gear 546 and is pivotally coupled to the figure. A reduction gear 572 is coaxially coupled to the second output gear 570 and is meshed with the eyeball gear 524. In this regard, as the second drive gear rotates in one direction it causes the eyeballs to rotate in a first direction (e.g., upward or downward) and similarly as the second drive gear rotates in an opposite direction it causes the eyeballs to rotate in an opposite direction.

The third drive gear 548 is coupled with a third output gear 574 which is coupled to an intermediate gear 576 via a second output shaft which is coupled to the figure such that rotation of the third output gear causes rotation on the intermediate gear. The intermediate gear is meshed with the gear drive gear section 538 formed on the drive leg portion of brow moving structure. In this regard, rotation of the third drive gear 548 in a first causes the brow moving structure to rotate about its pivot axis 540 and to move the brow in a first direction (e.g., upward or downward), whereas rotation of the third drive gear in an opposite direction will cause the brows to move in a direction opposite the first brow moving direction.

Thus, rotation of the drive shaft 550 causes the movement in the mouth and surrounding skin as well as movement of the eyeballs and eyebrows. By offsetting the location of the gear portions of the drive gears and by controlling the rotation and direction of rotation of the motors, the movement of the mouth and surrounding skin, eyes, and eyebrow can be controlled.

The output and drive gears used in the exemplary embodiment geneva gear assembly shown in FIG. 20 may be the same as the output and drive gears described in relation to any of the aforementioned embodiment toys.

Figure 21:
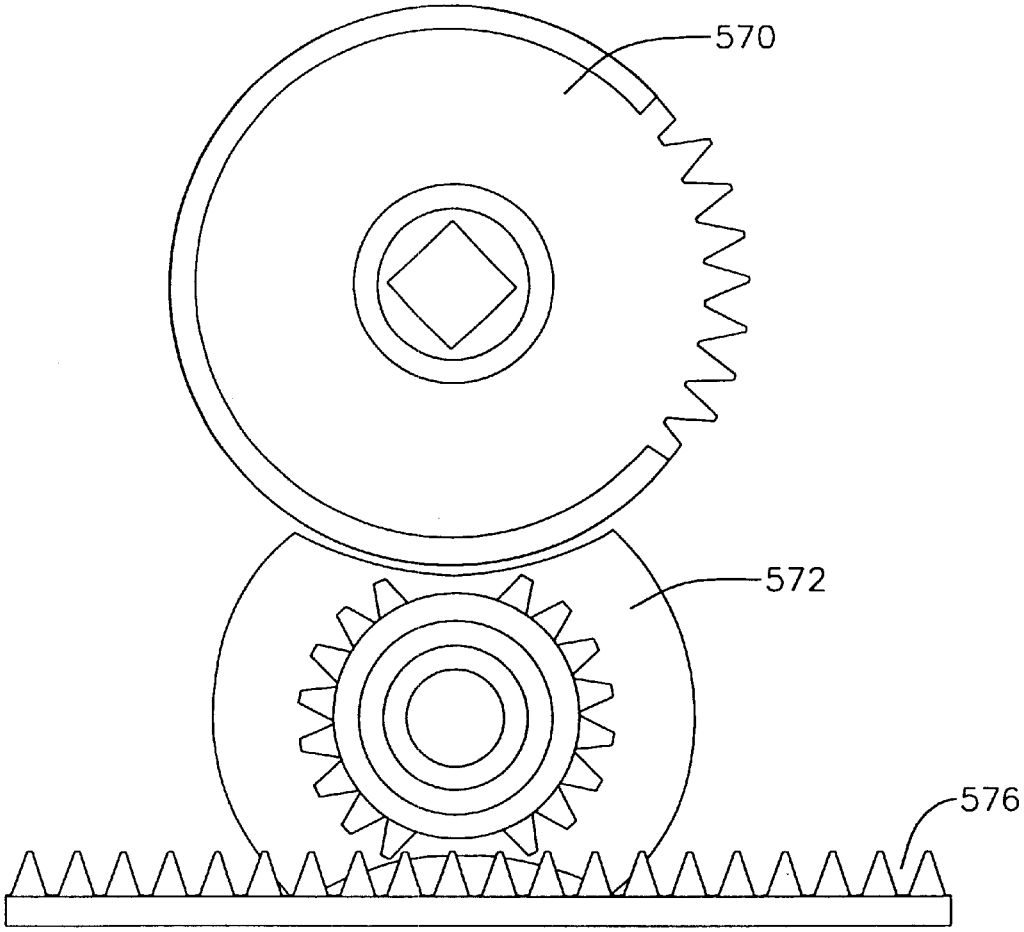
FIG. 21 is an end view another embodiment geneva gear assembly that may be incorporated in a toy of the present invention.

The inventive toys may incorporate other geneva assemblies as may be required for a desired part movement. For example, the geneva gear assembly may include a drive gear 570 which is coupled to an output gear 572 which is coupled to a rack gear 574 as shown in FIG. 21. Moving parts may be coupled to the output gear and/or the rack gear.

Furthermore, the geneva gear assemblies may be coupled to the parts they move with gears and/or pulleys as necessary. For example, the in alternate embodiments, the exemplary geneva gear assemblies described which are coupled to the parts using pulleys and lines may be coupled to the parts using gears and/or pulleys with lines. Similarly, in further alternate embodiments, the embodiments herein having pulleys coupled to the parts, may be geneva gear assemblies which are coupled to the parts they drive via gears may be coupled to the parts with pulleys and lines and/or gears.

The geneva gear assemblies incorporated in the inventive toys may have a single drive gear driving multiple output gears or may have multiple drive gears driven by the same motor driving multiple output gears. Furthermore each drive gear and output gear may have a single or multiple gear tooth sections and a single or multiple stop surfaces or stop teeth.

In alternative embodiment toys a single motor may be used to drive multiple geneva gear assemblies. Furthermore, with each toy a computer or other type of processor may be used to control the motors and thus the movement of the toy moving parts. The movement can be programmed into the computer or may be responsive to events sensed by sensors located throughout the toy and connected to the computer. The sensors may be used throughout the toy to allow the toy to interact with a child playing with it as well as with its environment.

Use of geneva gear assemblies to move the moving parts of toys have many advantages. For example, the geneva gear assemblies provide push-pull mechanisms. In other words, the geneva assemblies can provide push and pull (i.e., opposite direction) forces to the parts that they drive, i.e., they provide a positive drive to the parts that they drive. This eliminates the need for springs which provide a countering force in the toy parts that are driven by mechanisms providing either a push or a pull force but not both. By not incorporating springs, the geneva gears conserve the use of energy that is required to overcome the spring force for moving a part, consequently require a smaller force for moving such part. Moreover, with geneva gear assemblies, once the activation of a part is completed, the output gear driving such part is locked. Consequently, a minimum or no motor force is spent on the locked gear when the motor is driving the other output gears.

What is claimed is:

1. A toy comprising:

a plurality of moving parts;

a geneva gear assembly comprising, a drive gear comprising a plurality of teeth arcuately around a portion of the drive gear, and a stop surface around a portion of the drive gear, a first output gear comprising a first set of teeth for coupling with the teeth of the drive gear and a first stop tooth for coupling with the stop surface, a first pulley coupled to the first output gear, a second output gear comprising a first set of teeth for meshing with the teeth of the drive gear and a first stop tooth for coupling with the stop surface, a second pulley coupled to the second output gear;

a first line coupled to the first pulley and to a first of said plurality of moving parts;

a second line coupled to the second pulley and to a second of said plurality of moving parts; and a motor for driving the drive gear.

2. A toy as recited in claim 1 wherein the stop tooth of the first output gear stop tooth is engaged with the stop surface when the first set of teeth of the second output gear are meshed with the teeth of the drive gear.

3. A toy are recited in claim 1 wherein the stop surface can be simultaneously engaged by the stop tooth of the first output gear and the stop tooth of the second output gear.

4. A toy as recited in claim 1 wherein the first output gear comprises a second set of teeth spaced apart from the first set of teeth of the first output gear.

5. A toy as recited in claim 4 wherein the first output gear further comprises a second stop tooth between the first and second sets of teeth of the first output gear.

6. A toy as recited in claim 5 wherein the second output gear comprises a second set of teeth spaced apart from the first set of teeth of the second output gear.

7. A toy as recited in claim 6 wherein the second output gear further comprises a second stop tooth between the first and second sets of teeth of the second output gear.

8. A toy as recited in claim 1 wherein the stop surface is defined by a periphery of the drive gear.

9. A toy as recited in claim 1 wherein the stop surface is formed on an arcuate member extending from the drive gear.

10. A toy as recited in claim 1 wherein the drive gear teeth are formed by a plurality of pins extending from the drive gear.

11. A toy as recited in claim 1 wherein the drive gear teeth are formed on a periphery of the drive gear.

12. A toy as recited in claim 1 further comprising a spring coupling the first pulley to the first output gear.

13. A toy as recited in claim 12 further comprising a second spring coupling the second pulley to the second output gear.

14. A toy as recited in claim 1 further comprising:

a third output gear for coupling the with the second output gear, the third output gear comprising a set of gear teeth and a stop surface;

a third pulley coupled to the third output gear; and a third line coupled to the third pulley and to a third of said plurality of moving parts.

15. A toy as recited in claim 14 wherein the second output gear comprises a second set of teeth coaxial with the first set of teeth for meshing with the set of teeth of the third output gear and a stop tooth for engaging the stop surface of the third output gear.

16. A toy as recited in claim 12 further comprising:

a second geneva gear assembly comprising, a second drive gear comprising a plurality of teeth arcuately around a portion of the drive gear, and stop surface spaced apart from the teeth, a fourth output gear comprising, a first set of teeth for meshing with the teeth of the second drive gear, a first stop tooth for engaging the stop surface of the second drive gear, and a second set of teeth for coupling with the teeth of the third output gear, a fourth pulley coupled to the forty output gear, a fifth output gear comprising a first set of teeth for meshing with the teeth of the second drive gear and a first stop tooth for engaging the stop surface of the second drive gear, a fifth pulley coupled to the fifth output gear;

a fourth line coupled to the fourth pulley and to a fourth of said plurality of moving parts;

a fifth line coupled to the fifth pulley and to a fifth of said plurality of moving parts; and a second motor for driving the second drive gear.

17. A toy as recited in claim 16 further comprising:

a slot formed on the third output gear; and a cam member for engaging the slot for preventing rotation of the third output gear.

18. A toy as recited in claim 17 wherein the cam is spring loaded in a position for engaging the slot formed on the third output gear, the toy further comprising:

a first cam portion extending from the second output gear, wherein rotation of the second output gear causes the first cam portion to urge the cam member to disengage from the slot; and a second cam portion extending from the third output gear, wherein rotation of the third output gear causes the second cam portion to urge the cam member to disengage from the slot.

19. A toy as recited in claim 16 further comprising a first intermediate gear for coupling the second output gear to the third output gear.

20. A toy as recited in claim 19 further comprising a second intermediate gear for coupling the fourth output gear to the third output gear.

21. A toy as recited in claim 20 wherein each intermediate gear comprises a first section and a second section coaxial with the first section, wherein the second and fourth output gears each comprise a second set of teeth coaxial with the first set of teeth for meshing with the teeth on one of said intermediate gears.

22. A toy as recited in claim 20 further comprising:

a slot formed on the third output gear;

a cam member for engaging the slot for preventing rotation of the third output gear;

a first cam portion extending from the first intermediate gear, wherein rotation of the first intermediate gear causes the first cam portion to urge the cam member to disengage from the slot; and a second cam portion extending from the second intermediate gear, wherein rotation of the second intermediate gear causes the second cam portion to urge the cam member to disengage from the slot.

23. A toy comprising:

a housing comprising a plurality of moving parts;

a motor; and a geneva gear assembly comprising, a first drive gear coupled to the motor and comprising a first set of teeth arcuately around a portion of the first drive gear, and a first stop surface arcuately extending around a portion of the first drive gear, a second drive gear coupled to the motor and comprising a second set of teeth arcuately around a portion of the second drive gear, and a second stop surface arcuately extending around a portion of the second drive gear, a first output gear comprising a first set of teeth for coupling with the teeth of the first drive gear and a first stop tooth for engaging the first stop surface, a first pulley coupled to the first output gear, a second output gear comprising a first set of teeth for coupling with the teeth of the second drive gear, a second pulley coupled to the second output gear;

a first line coupled to the first pulley and to a first of said plurality of moving parts; and a second line coupled to the second pulley and to a second of said plurality of moving parts.

24. A toy as recited in claim 23 further comprising a drive shaft driven by the motor, wherein the first and second drive gears are mounted on the shaft and wherein rotation of the shaft causes the rotation of both drive gears.

25. A toy as recited in claim 24 further comprising an output gear shaft, wherein the first and second output gears are mounted on the output gear shaft.

26. A toy as recited in claim 25 wherein the first output gear can rotate relative to the output gear shaft and wherein the second output gear can rotate relative to the output gear shaft.

27. A toy as recited in claim 23 further comprising:

a first intermediate gear rotatably coupled to the housing for rotating about an axis of rotation, the first intermediate gear comprising a set of teeth for coupling with the first set of teeth of the second drive gear and a stop tooth for engaging the second stop surface;

a second intermediate gear comprising a first circular arc portion and a second portion extending from the first portion, wherein a plurality of teeth are formed on the arc portion for coupling with the teeth of the second output gear, wherein a slot is formed on the second portion, and wherein the second intermediate gear is rotatably coupled to the housing about a central axis of the arc portion; and a cam rotatably coupled to the first intermediate gear about an axis offset from the axis of rotation of the first intermediate gear and offset from a central axis of the cam, wherein the cam extends into the slot, and wherein the second drive gear drives the first intermediate gear causing the cam to rotate the second intermediate gear about the central axis of the arc portion, causing the second output gear to rotate.

28. A toy as recited in claim 27 wherein the set of teeth of the second intermediate gear are meshed with the teeth of the second output gear.

29. A toy as recited in claim 27 wherein the teeth of the first intermediate gear can mesh with the teeth of the second drive gear.

30. A toy as recited in claim 23 wherein the second output gear comprises a periphery and wherein the set of teeth of the second output gear span the entire periphery.

31. A toy as recited in claim 23 wherein the first output gear comprises a second set of teeth spaced apart from the first set of teeth of the first output gear.

32. A toy as recited in claim 31 wherein the first output gear further comprises a second stop tooth between the first and second sets of teeth of the first output gear.

33. A toy as recited in claim 23 wherein the second output gear comprises a stop tooth.

34. A toy as recited in claim 33 wherein the second output gear comprises a second set of teeth spaced apart from the first set of teeth of the second output gear.

35. A toy as recited in claim 34 wherein the second output gear further comprises a second stop tooth between the first and second sets of teeth of the second output gear.

36. A toy comprising:

a housing comprising a plurality of moving parts;

a motor; and a geneva gear assembly comprising, a first drive gear coupled to the motor and comprising a first set of teeth arcuately around a portion of the first drive gear, and a first stop surface arcuately extending around a portion of the first drive gear, a second drive gear coupled to the motor and comprising a second set of teeth arcuately around a portion of the second drive gear, and a second stop surface arcuately extending around a portion of the second drive gear, a first output gear comprising a first set of teeth for coupling with the teeth of the first drive gear and a first stop tooth for engaging the first stop surface, the first output gear having an axis of rotation, a second output gear comprising a first set of teeth for coupling with the teeth of the second drive gear and a second stop tooth for engaging the second stop surface, the second output gear having an axis of rotation, a first rack gear having gear teeth and comprising a body having a slot, a first cam extending from the first output gear and offset from the axis of rotation of the first output gear and extending in the slot of the first rack gear, wherein a full rotation of the first output gear causes the first cam to move the first rack gear in a first direction and in a second opposite direction, a second rack gear having gear teeth and comprising a body having a slot, a second cam extending from the second output gear offset from the axis of rotation of the second output gear and extending in the slot of the second rack gear, wherein a full rotation of the second output gear causes the second cam to move the second rack gear in a first direction and in a second opposite direction, a first pulley coupled to the first rack gear, wherein movement of the first rack gear causes rotation of the first pulley ; and a second pulley coupled to the second rack gear, wherein movement of the second rack gear causes rotation of the second pulley;

a first line coupled to the first pulley and to a first of said plurality of moving parts; and a second line coupled to the second pulley and to a second of said plurality of moving parts.

37. A toy as recited in claim 36 further comprising:

a first gear coupled to the first pulley and meshed with the first rack gear; and a second gear coupled to the second pulley and meshed with the second rack gear.

38. A toy as recited in claim 37 wherein the body of each rack gear is a frame and wherein the gear teeth of the each rack gear are formed on an inner surface of the frame.

39. A toy as recited in claim 37 wherein the geneva gear assembly further comprises a drive shaft coupled to the motor, wherein the first and second drive gears are mounted on the drive shaft and wherein rotation of the drive shaft causes rotation of said drive gears.

40. A toy as recited in claim 39 wherein the first and second pulleys are rotatably coupled to the drive shaft, wherein the first and second pulleys can rotate relative to the drive shaft.

41. A toy as recited in claim 40 further comprising a gear plate comprising, wherein the drive shaft penetrates the gear plate, and wherein the first output gear is rotatably coupled to a first side of the gear plate and wherein the second output gear is rotatably coupled to a second side of the gear plate opposite the first side, and wherein the gear plate is located between the first and second drive gears.

42. A toy as recited in claim 39 further comprising:

a third drive gear coupled to the drive shaft, wherein rotation of the third drive gear causes rotation of the drive shaft; and a worm gear driven by the motor and meshed with the third gear.

43. A toy comprising:

a housing comprising a plurality of moving parts;

a motor; and a geneva gear assembly comprising, a first drive gear coupled to the motor and comprising a set of teeth arcuately around a portion of the first drive gear, and a stop surface arcuately extending around a portion of the first drive gear, a second drive gear coupled to the motor and comprising a set of teeth arcuately around a portion of the second drive gear, and a stop surface arcuately extending around a portion of the second drive gear, a first output gear comprising a set of teeth for coupling with the teeth of the first drive gear and a stop tooth for engaging the stop surface of the first drive gear, a second output gear comprising a set of teeth for coupling with the teeth of the second drive gear, a first of said plurality of moving parts coupled to the first output gear for being moved as the first output gear rotates; and a second of said plurality of moving parts coupled to the second output gear for being moved as the second output gear rotates.

44. A toy as recited in claim 43 wherein the geneva gear assembly further comprises:

a third drive gear coupled to the motor and comprising a set of teeth arcuately around a portion of the third drive gear, and a stop surface arcuately extending around a portion of the third drive gear; and a third output gear comprising a set of teeth for coupling with the teeth of the third drive gear; and a third of said plurality of moving parts coupled to the third output gear for being moved as the third output gear rotates.

45. A toy as recited in claim 43 further comprising;

an output shaft coupled to the first output gear for being rotated as the first output gear rotates;

a first bevel gear formed on end of the shaft; and a fourth output gear comprising a second bevel gear coupled to the first bevel gear, wherein the first of said plurality of moving parts is coupled to the fourth output gear.

46. A toy as recited in claim 45 wherein the fourth output gear comprises a body having a periphery and wherein the second bevel gear extends from the body, the fourth output gear further comprising a cylindrical opening intersecting the periphery of the body, and wherein the first of said plurality of moving parts comprises a cylindrical member fitted in said opening, and wherein rotation the fourth output gear causes movement of said first of said plurality of moving parts.

47. A toy comprising:

a plurality of moving parts; and a geneva gear assembly comprising, a drive gear comprising a plurality of teeth spanning a portion of the drive gear, and a stop surface spanning a portion of the drive gear, and a first output gear comprising a first set of adjacent teeth for coupling with the teeth of the drive gear and a first stop tooth separate and spaced apart from said first set of adjacent teeth for coupling with the stop surface, wherein the first output gear is coupled to a first part of said plurality of moving parts for moving said first part.

48. A toy as recited in claim 47 wherein the first output gear comprises a second set of adjacent teeth spaced apart from the first set of teeth of the first output gear.

49. A toy as recited in claim 48 wherein the first output gear further comprises a second stop tooth between the first and second sets of teeth of the first output gear.

50. A toy as recited in claim 47 further comprising:

a second geneva gear assembly comprising, a second drive gear and comprising a first set of teeth spanning a portion of the second drive gear, and a stop surface spanning a portion of the second drive gear, and a second output gear comprising a first set of teeth for coupling with the teeth of the second drive gear and a stop tooth for coupling with the stop surface of the second drive gear, wherein the second output gear is coupled to a second part of said plurality of moving parts for moving said second part.

51. A toy as recited in claim 50 wherein the second output gear comprises a second set of teeth spaced apart from the first of teeth of the second output gear.

52. A toy as recited in claim 51 wherein the second output gear further comprises a second stop tooth between the first and second sets of teeth of the second output gear.

53. A toy as recited in claim 52 further comprising a motor for driving the first and second drive gears.

54. A toy as recited in claim 53 wherein the motor drives the first and second drive gears simultaneously.

55. A toy comprising:

plurality of moving parts; and a geneva gear assembly comprising, a drive gear comprising a plurality of teeth spanning a portion of the drive gear, and a stop surface spanning a portion of the drive gear, a first output gear comprising a first set of teeth for coupling with the teeth of the drive gear and a first stop tooth for coupling with the stop surface, wherein the first output gear is coupled to a first part of said plurality of moving parts for moving said first part, and a second output gear comprising a first set of teeth for coupling with the teeth of the drive gear and a first stop tooth for coupling with the stop surface, wherein the second output gear is coupled to a second part of said plurality of moving parts for moving said second part.

56. A toy are recited in claim 55 wherein the stop surface can be simultaneously coupled with the stop tooth of the first output gear and the stop tooth of the second output gear.

* * * * *